US008796952B2

(12) United States Patent
Van de Ven

(10) Patent No.: US 8,796,952 B2
(45) Date of Patent: Aug. 5, 2014

(54) SEMICONDUCTOR LIGHT EMITTING DEVICES HAVING SELECTABLE AND/OR ADJUSTABLE COLOR POINTS AND RELATED METHODS

(75) Inventor: Antony Paul Van de Ven, Sai Kung (HK)

(73) Assignee: Cree, Inc., Durham, NC (US)

( * ) Notice: Subject to any disclaimer, the term of this patent is extended or adjusted under 35 U.S.C. 154(b) by 308 days.

(21) Appl. No.: 13/039,572

(22) Filed: Mar. 3, 2011

(65) Prior Publication Data

US 2012/0223657 A1 Sep. 6, 2012

(51) Int. Cl.
*H05B 37/02* (2006.01)

(52) U.S. Cl.
USPC ..... 315/297; 315/307; 315/312

(58) Field of Classification Search
USPC ..... 315/149–159, 185 R, 291, 294, 297, 315/307–309, 312
See application file for complete search history.

(56) References Cited

U.S. PATENT DOCUMENTS

| | | | | |
|---|---|---|---|---|
| 6,350,041 | B1 | 2/2002 | Tarsa et al. | |
| 6,384,492 | B1 | 5/2002 | Iversen et al. | |
| 6,600,175 | B1 | 7/2003 | Baretz et al. | |
| 6,967,116 | B2 | 11/2005 | Negley | |
| 7,005,679 | B2 | 2/2006 | Tarsa et al. | |
| 7,029,935 | B2 | 4/2006 | Negley et al. | |
| 7,042,020 | B2 | 5/2006 | Negley | |
| 7,183,582 | B2 | 2/2007 | Imamura | |
| 7,326,583 | B2 | 2/2008 | Andrews et al. | |
| 7,517,728 | B2 | 4/2009 | Leung et al. | |
| 7,612,383 | B2 | 11/2009 | Andrews et al. | |
| 7,615,795 | B2 | 11/2009 | Baretz et al. | |
| 7,791,092 | B2 | 9/2010 | Tarsa et al. | |
| 7,799,586 | B2 | 9/2010 | Leung et al. | |
| 8,212,466 | B2 * | 7/2012 | Negley et al. | 313/498 |
| 8,427,079 | B2 * | 4/2013 | Van Der Veen et al. | 315/360 |
| 8,436,549 | B2 | 5/2013 | Hasnain | |
| 8,624,505 | B2 | 1/2014 | Huang | |
| 2006/0049416 | A1 | 3/2006 | Baretz et al. | |
| 2007/0278934 | A1 | 12/2007 | Van de Ven et al. | |
| 2008/0106895 | A1 | 5/2008 | Van de Ven et al. | |
| 2008/0130281 | A1 | 6/2008 | Negley | |
| 2008/0136313 | A1 | 6/2008 | Van de Ven et al. | |
| 2008/0179602 | A1 | 7/2008 | Negley et al. | |
| 2008/0224597 | A1 | 9/2008 | Baretz et al. | |

(Continued)

OTHER PUBLICATIONS

Hoelen, C. et al., "Color-consistent LED modules for general lighting", *Proc. Of SPIE*, vol. 7231, Dec. 2009, 12 Pages.

(Continued)

*Primary Examiner* — Tung X Le
(74) *Attorney, Agent, or Firm* — Myers Bigel Sibley & Sajovec, P.A.

(57) ABSTRACT

Semiconductor light emitting devices include a first string of at least one blue-shifted-yellow LED, a second string of at least one blue-shifted-green LED, and a third string of at least one LED that emits light in the red color range. These devices include at least a first circuit that is configured to provide an operating current to at least one of the first LED or the second LED and a second circuit that is configured to provide an operating current to the third light source. The drive currents supplied by the first and second circuits may be independently controlled to set a color point of the light emitting device at a desired color point.

23 Claims, 11 Drawing Sheets

(56) References Cited

U.S. PATENT DOCUMENTS

| | | | | |
|---|---|---|---|---|
| 2008/0224598 | A1 | 9/2008 | Baretz et al. | |
| 2009/0167185 | A1* | 7/2009 | Cheng | 315/56 |
| 2009/0184616 | A1* | 7/2009 | Van De Ven et al. | 313/1 |
| 2010/0020532 | A1 | 1/2010 | Negley | |
| 2010/0127283 | A1 | 5/2010 | Van de Ven et al. | |
| 2010/0245227 | A1 | 9/2010 | Chen et al. | |
| 2010/0254129 | A1 | 10/2010 | Le Toquin et al. | |
| 2010/0254130 | A1 | 10/2010 | Van de Ven et al. | |
| 2010/0290221 | A1 | 11/2010 | Tarsa et al. | |
| 2010/0301360 | A1 | 12/2010 | Van de Ven et al. | |
| 2010/0314996 | A1 | 12/2010 | Van de Ven et al. | |
| 2011/0006330 | A1 | 1/2011 | Leung et al. | |
| 2011/0019399 | A1 | 1/2011 | Van de Ven et al. | |
| 2011/0043137 | A1 | 2/2011 | Negley et al. | |
| 2011/0115407 | A1* | 5/2011 | Wibben et al. | 315/294 |
| 2011/0204807 | A1 | 8/2011 | Hashizume et al. | |
| 2011/0291564 | A1 | 12/2011 | Huang | |
| 2012/0038286 | A1 | 2/2012 | Hasnain | |
| 2012/0038291 | A1 | 2/2012 | Hasnain | |
| 2012/0062205 | A1 | 3/2012 | Levesque et al. | |
| 2012/0223657 | A1 | 9/2012 | Van de Ven | |

OTHER PUBLICATIONS

International Search Report Corresponding to International Application No. PCT/US12/26011; Date of Mailing: Sep. 4, 2012; 15 Pages.

Kim, A.Y. et al., "Performance of High-Power AlInGaN Light Emitting Diodes", *Phys. Stat. Sol.* (a) 188, No. 1, pp. 15-21, Dec. 2001.

Notification Concerning Transmittal of International Preliminary Report on Patentability corresponding to PCT/US2012/026011; Date of Mailing: Mar. 20, 2014, 8 pages.

* cited by examiner

| Target CTT (K) | Trapezoid | | Center Point | | Center Point CCT (K) |
|---|---|---|---|---|---|
| | x | y | x | y | |
| 2700 | 0.4813 | 0.4319 | 0.478 | 0.4101 | 2725 |
| | 0.4562 | 0.4260 | | | |
| | 0.4373 | 0.3893 | | | |
| | 0.4593 | 0.3944 | | | |
| 3000 | 0.4562 | 0.4260 | 0.4338 | 0.4030 | 3027 |
| | 0.4299 | 0.4165 | | | |
| | 0.4147 | 0.3814 | | | |
| | 0.4373 | 0.3893 | | | |
| 3500 | 0.4299 | 0.4165 | 0.4073 | 0.3917 | 3464 |
| | 0.3996 | 0.4015 | | | |
| | 0.3889 | 0.3690 | | | |
| | 0.4147 | 0.3814 | | | |
| 4000 | 0.4006 | 0.4044 | 0.3818 | 0.3797 | 3985 |
| | 0.3736 | 0.3874 | | | |
| | 0.3670 | 0.3578 | | | |
| | 0.3898 | 0.3716 | | | |
| 4500 | 0.3736 | 0.3874 | 0.3611 | 0.3658 | 4503 |
| | 0.3548 | 0.3736 | | | |
| | 0.3512 | 0.3465 | | | |
| | 0.3670 | 0.3578 | | | |
| 5000 | 0.3551 | 0.3760 | 0.3447 | 0.3553 | 5027 |
| | 0.3376 | 0.3616 | | | |
| | 0.3366 | 0.3369 | | | |
| | 0.3515 | 0.3478 | | | |
| 5700 | 0.3376 | 0.3616 | 0.3287 | 0.3417 | 5666 |
| | 0.3207 | 0.3462 | | | |
| | 0.3222 | 0.3243 | | | |
| | 0.3366 | 0.3369 | | | |
| 6500 | 0.3205 | 0.3481 | 0.3123 | 0.3282 | 6532 |
| | 0.3028 | 0.3304 | | | |
| | 0.3068 | 0.3113 | | | |
| | 0.3221 | 0.3261 | | | |

*FIG. 8A*

| | | | Lumen Mix Percentages | | | BXY/BSG Mix Color Point | |
|---|---|---|---|---|---|---|---|
| CCT (K) | CRI Ra | LER | Red L% | BSY L% | BSG L% | x | y |
| 6532 | 94 | 310 | 10% | 30% | 60% | 0.2682 | 0.3302 |
| 5666 | 95 | 318 | 10% | 40% | 50% | 0.2825 | 0.3456 |
| 5027 | 95 | 325 | 11% | 48% | 41% | 0.2970 | 0.3614 |
| 4503 | 95 | 330 | 12% | 54% | 34% | 0.3090 | 0.3745 |
| 3985 | 96 | 337 | 13% | 62% | 26% | 0.3225 | 0.3923 |
| 3465 | 96 | 341 | 15% | 67% | 18% | 0.3421 | 0.4104 |
| 3045 | 96 | 343 | 17% | 72% | 10% | 0.3599 | 0.4297 |
| 2725 | 94 | 344 | 20% | 75% | 5% | 0.3747 | 0.4458 |

*FIG. 8B*

SEMICONDUCTOR LIGHT EMITTING DEVICES HAVING SELECTABLE AND/OR ADJUSTABLE COLOR POINTS AND RELATED METHODS

BACKGROUND

The present invention relates to light emitting devices and, more particularly, to semiconductor light emitting devices that include multiple different types of light emitting devices.

A wide variety of light emitting devices are known in the art including, for example, incandescent light bulbs, fluorescent lights and semiconductor light emitting devices such as light emitting diodes ("LEDs"). LEDs have the potential to exhibit very high efficiencies relative to conventional incandescent or fluorescent lights. However, significant challenges remain in providing LED lamps that simultaneously achieve high efficiencies, high luminous flux, good color reproduction and acceptable color stability.

LEDs generally include a series of semiconductor layers that may be epitaxially grown on a substrate such as, for example, a sapphire, silicon, silicon carbide, gallium nitride or gallium arsenide substrate. One or more semiconductor p-n junctions are formed in these epitaxial layers. When a sufficient voltage is applied across the p-n junction, electrons in the n-type semiconductor layers and holes in the p-type semiconductor layers flow toward the p-n junction. As the electrons and holes flow toward each other, some of the electrons will "collide" with corresponding holes and recombine. Each time this occurs, a photon of light is emitted, which is how LEDs generate light. The wavelength distribution of the light generated by an LED generally depends on the semiconductor materials used and the structure of the thin epitaxial layers that make up the "active region" of the device (i.e., the area where the light is generated).

Most LEDs are nearly monochromatic light sources that appear to emit light having a single color. Thus, the spectral power distribution of the light emitted by most LEDs is tightly centered about a "peak" wavelength, which is the single wavelength where the spectral power distribution or "emission spectrum" of the LED reaches its maximum as detected by a photo-detector. The "width" of the spectral power distribution of most LEDs is between about 10 nm and 30 nm, where the width is measured at half the maximum illumination on each side of the emission spectrum (this width is referred to as the full-width-half-maximum or "FWHM" width). LEDs are often identified by their "peak" wavelength or, alternatively, by their "dominant" wavelength. The dominant wavelength of an LED is the wavelength of monochromatic light that has the same apparent color as the light emitted by the LED as perceived by the human eye. Because the human eye does not perceive all wavelengths equally (it perceives yellow and green better than red and blue), and because the light emitted by most LEDs is actually a range of wavelengths, the color perceived (i.e., the dominant wavelength) may differ from the peak wavelength.

In order to use LEDs to generate white light, LED lamps have been provided that include several LEDs that each emit a light of a different color. The different colors combine to produce a desired intensity and/or color of white light. For example, by simultaneously energizing red, green and blue LEDs, the resulting combined light may appear white, or nearly white, depending on, for example, the relative intensities, peak wavelengths and spectral power distributions of the source red, green and blue LEDs.

White light may also be produced by partially or fully surrounding a blue, purple or ultraviolet LED with one or more luminescent materials such as phosphors that convert some of the light emitted by the LED to light of one or more other colors. The combination of the light emitted by the LED that is not converted by the luminescent material(s) and the light of other colors that are emitted by the luminescent material(s) may produce a white or near-white light.

As one example, a white LED lamp may be formed by coating a gallium nitride-based blue LED with a yellow luminescent material such as a cerium-doped yttrium aluminum garnet phosphor (which has the chemical formula $Y_3Al_5O_{12}$:Ce, and is commonly referred to as YAG:Ce). The blue LED produces an emission with a peak wavelength of, for example, about 460 nm. Some of blue light emitted by the LED passes between and/or through the YAG:Ce phosphor particles without being down-converted, while other of the blue light emitted by the LED is absorbed by the YAG:Ce phosphor, which becomes excited and emits yellow fluorescence with a peak wavelength of about 550 nm (i.e., the blue light is down-converted to yellow light). A viewer will perceive the combination of blue light and yellow light that is emitted by the coated LED as white light. This light typically perceived as being cool white in color, as it primarily includes light on the lower half (shorter wavelength side) of the visible emission spectrum. To make the emitted white light appear more "warm" and/or exhibit better color rendering properties, red-light emitting luminescent materials such as $CaAlSiN_3$ based phosphor particles may be added to the coating. Alternatively, the cool white emissions from the combination of the blue LED and the YAG:Ce phosphor may be supplemented with a red LED (e.g., comprising AlInGaP, having a dominant wavelength of approximately 619 nm) to provide warmer light.

Phosphors are the luminescent materials that are most widely used to convert a single-color (typically blue or violet) LED into a white LED. Herein, the term "phosphor" may refer to any material that absorbs light at one wavelength and re-emits light at a different wavelength in the visible spectrum, regardless of the delay between absorption and re-emission and regardless of the wavelengths involved. Thus, the term "phosphor" encompasses materials that are sometimes called fluorescent and/or phosphorescent. In general, phosphors may absorb light having first wavelengths and re-emit light having second wavelengths that are different from the first wavelengths. For example, "down-conversion" phosphors may absorb light having shorter wavelengths and re-emit light having longer wavelengths. In addition to phosphors, other luminescent materials include scintillators, day glow tapes, nanophosphors, quantum dots, and inks that glow in the visible spectrum upon illumination with (e.g., ultraviolet) light.

A medium that includes one or more luminescent materials that is positioned to receive light that is emitted by an LED or other semiconductor light emitting device is referred to herein as a "recipient luminophoric medium." Exemplary recipient luminophoric mediums include layers having luminescent materials that are coated or sprayed directly onto, for example, a semiconductor light emitting device or on surfaces of a lens or other elements of the packaging thereof, and clear encapsulents (e.g., epoxy-based or silicone-based curable resin) that include luminescent materials that are arranged to partially or fully cover a semiconductor light emitting device. A recipient luminophoric medium may include one medium layer or the like in which one or more luminescent materials are mixed, multiple stacked layers or mediums, each of which may include one or more of the same or different luminescent materials, and/or multiple spaced apart layers or mediums, each of which may include the same or different luminescent materials.

SUMMARY

Pursuant to some embodiments of the present invention, light emitting devices are provided which include first, second and third strings of at least one LED each, and a drive circuit that is configured to set the relative drive currents provided to the first and second strings so that the color point on the 1931 CIE Chromaticity Diagram of the combined output of the first and second strings is approximately on a line that extends on the 1931 CIE Chromaticity Diagram through a pre-selected color point and a color point of an output of the third string. The drive circuit is further configured to set the relative drive currents provided to the third string relative to the drive currents provided to the first and second strings so that the color point on the 1931 CIE Chromaticity Diagram of the combined output of the light emitting device is approximately at the pre-selected color point.

In some embodiments, one of the strings (e.g., the first string) includes at least one blue-shifted-yellow LED, and one of the strings (e.g., the second string) includes at least one blue-shifted-green LED. Moreover, the third string may include at least one LED that emits radiation having a spectral power distribution that has a peak with a dominant wavelength between 600 and 660 nm. The color point on the 1931 CIE Chromaticity Diagram of the combined output of the device may be within three MacAdam ellipses from the pre-selected color point.

Pursuant to further embodiments of the present invention, methods of tuning a multi-emitter semiconductor light emitting device to a desired color point are provided. Pursuant to these methods, the relative drive currents provided to a first string of at least one LED and to a second string of at least one LED are set so that the color point on the 1931 CIE Chromaticity Diagram of the combined output of the first and second strings is approximately on a line that extends on the 1931 CIE Chromaticity Diagram through the desired color point and a color point of a combined output of a third string of at least one LED. Then a drive current provided to the third string of at least one LED is set so that the color point on the 1931 CIE Chromaticity Diagram of the combined output of the device is approximately at the desired color point.

In some embodiments, one of the strings (e.g., the first string) includes at least one blue-shifted-yellow LED, and one of the strings (e.g., the second string) includes at least one blue-shifted-green LED. The third string may include at least one LED that emits radiation having a spectral power distribution that has a peak with a dominant wavelength between 600 and 660 nm.

Pursuant to still further embodiments, semiconductor light emitting devices are provided that include a first LED that emits radiation having a peak wavelength between 400 and 490 nm that includes a first recipient luminophoric medium. The color point of the combined light output of the first LED and the first recipient luminophoric medium falls within the region on the 1931 CIE Chromaticity Diagram defined by x, y chromaticity coordinates (0.32, 0.40), (0.36, 0.48), (0.43 0.45), (0.36, 0.38), (0.32, 0.40). These devices further include a second LED that emits radiation having a peak wavelength between 400 and 490 nm that includes a second recipient luminophoric medium. The color point of the combined light output of the second LED and the second recipient luminophoric medium falls within the region on the 1931 CIE Chromaticity Diagram defined by x, y chromaticity coordinates (0.35, 0.48), (0.26, 0.50), (0.13 0.26), (0.15, 0.20), (0.26, 0.28), (0.35, 0.48). These devices also include a third light source that emits radiation having a dominant wavelength between 600 and 720 nm. The device also has a first circuit that is configured to provide an operating current to at least one of the first LED or the second LED and an independently controllable second circuit that configured to provide an operating current to the third light source.

In some embodiments, the first circuit is configured to provide an operating current to the first LED, and the device further includes a third circuit that is configured to provide an operating current to the second LED. The first, second and third circuits may be controllable such that they can provide different operating currents to the respective first LED, second LED and third light source. The third light source may comprise, for example, an InAlGaP based LED or a third LED that emits radiation having a peak wavelength between 400 and 490 nm that includes a third recipient luminophoric medium that emits radiation having a dominant wavelength between 600 and 660 nm. The device may optionally include a fourth LED that emits radiation having a dominant wavelength between 490 and 515 nm. In such embodiments, one of the first or second circuits may be configured to provide an operating current to the fourth LED.

In some embodiments, the first, second and third circuits are configured to deliver operating currents to the respective first LED, the second LED and the third light source that cause the semiconductor light emitting device to generate radiation that is within three MacAdam ellipses from a selected color point on the black-body locus. The device may also include at least one additional first LED that emits radiation having a peak wavelength between 400 and 490 nm that includes a first recipient luminophoric medium. The color point of the combined light output of the at least one additional first LED and the first recipient luminophoric medium falls within the region on the 1931 CIE Chromaticity Diagram defined by x, y chromaticity coordinates (0.32, 0.40), (0.36, 0.48), (0.43 0.45), (0.36, 0.38), (0.32, 0.40). The device may further include at least one additional second LED that emits radiation having a peak wavelength between 400 and 490 nm that includes a second recipient luminophoric medium. The color point of the combined light output of the at least one additional second LED and the second recipient luminophoric medium falls within the region on the 1931 CIE Chromaticity Diagram defined by x, y chromaticity coordinates (0.35, 0.48), (0.26, 0.50), (0.13 0.26), (0.15, 0.20), (0.26, 0.28), (0.35, 0.48). The device may also include at least one additional third light source that emits radiation having a dominant wavelength between 600 and 660 nm. In such embodiments, the first circuit may be configured to provide an operating current to the first LED and the at least one additional first LED, the third circuit may be configured to provide an operating current to the second LED and the at least one additional second LED, and the second circuit may be configured to provide an operating current to the at least one additional third light source. In some embodiments, the semiconductor light emitting device may emit a warm white light having a correlated color temperature between about 2500K and about 4100K and a CRI Ra value of at least 90.

Pursuant to still further embodiments of the present invention, light emitting devices are provided that include a first LED string that includes at least one LED that has a first recipient luminophoric medium that includes a first luminescent material that emits light having a peak wavelength between 560 and 599 nm, a second LED string that includes at least one LED that has a second recipient luminophoric medium that includes a second luminescent material that emits light having a peak wavelength between 515 and 559 nm and a third LED string that includes at least one red light source that emits radiation having a dominant wavelength between 600 and 720 nm. These devices also include a first circuit that is configured to provide an operating current to the first or second strings, and a second circuit that is configured to provide an operating current to the third string.

In some embodiments, the first circuit is configured to provide an operating current to the first string, and the light emitting device further includes a third circuit that is configured to provide an operating current to the second string, and the first, second and third circuits may be controllable such that they can provide different operating currents to the respective first, second and third strings. The one red light source may be, for example, an InAlGaP based LED or at least one LED that has a third recipient luminophoric medium that includes a third luminescent material that emits light having a peak wavelength between 600 and 720 nm. The device may also optionally include another LED that emits radiation having a dominant wavelength between 490 and 515 nm.

In some embodiments, the first, second and third circuits may be configured to deliver operating currents to the respective first, second and third LED strings that generate combined light from the first, second and third LED strings that is within three MacAdam ellipses from a selected color point on the black-body locus. Moreover, the radiation emitted by the second recipient luminophoric medium of at least one of the LEDs in the second LED string may have a full-width-half-maximum emission bandwidth that extends into the cyan color range.

Pursuant to still further embodiments of the present invention, semiconductor light emitting devices are provided that include a first LED string that includes at least one first type of LED, a second LED string that includes at least one second type of LED, and a third LED string that includes at least one third type of LED. These devices also include a circuit that allows an end user of the semiconductor light emitting device to adjust the relative values of the drive current provided to the LEDs in the first and second LED strings to adjust a color point of the light emitted by the semiconductor light emitting device.

In some such embodiments, the first type of LED may be a BSY LED, the second type of LED may be a BSG LED and the third type of LED may be an LED that has one or more emission peaks that includes an emission peak having a dominant wavelength between 600 and 720 nm. The circuit that allows an end user of the semiconductor light emitting device to adjust the relative values of the drive current provided to the LEDs in the first and second LED strings may be configured to keep the overall luminous flux output by the semiconductor light emitting device relatively constant. In some embodiments, the device may also include a second circuit that allows an end user of the semiconductor light emitting device to adjust the amount of drive current provided to the LEDs in the first and second LED strings relative to the drive current provided to the LEDs in the third LED string. In some cases, the circuit may be configured to adjust the amount of drive current provided to the LEDs in the first through third strings to one of a plurality of pre-defined levels that correspond to pre-selected color points.

Pursuant to yet additional embodiments of the present invention, semiconductor light emitting devices are provided that include a first LED string that includes at least one first type of LED, a second LED string that includes at least one second type of LED and a third LED string that includes at least one third type of LED. These devices also include a circuit that automatically adjusts the relative values of the drive current provided to the LEDs in at least one of the first, second and third LED strings relative to the drive currents provided to other of the first, second and third LED strings.

In some embodiments, these devices may also include a control system that controls the circuit to automatically adjust the relative values of the drive current provided to the LEDs in at least one of the first, second and third LED strings relative to the drive currents provided to other of the first, second and third LED strings based on pre-programmed criteria. In other embodiments, the device may include a sensor that senses a characteristic of the semiconductor light emitting device (e.g., the temperature of the device) and a control system that controls the circuit responsive to the sensor to automatically adjust the relative values of the drive current provided to the LEDs in at least one of the first, second and third LED strings relative the drive currents provided to other of the first, second and third LED strings.

BRIEF DESCRIPTION OF THE DRAWINGS

FIGS. 8A and 8B are tables illustrating various parameters and simulated performance characteristics of devices according to embodiments of the present invention that are designed to achieve target color temperatures along the black-body locus.

DETAILED DESCRIPTION

Figure 1:
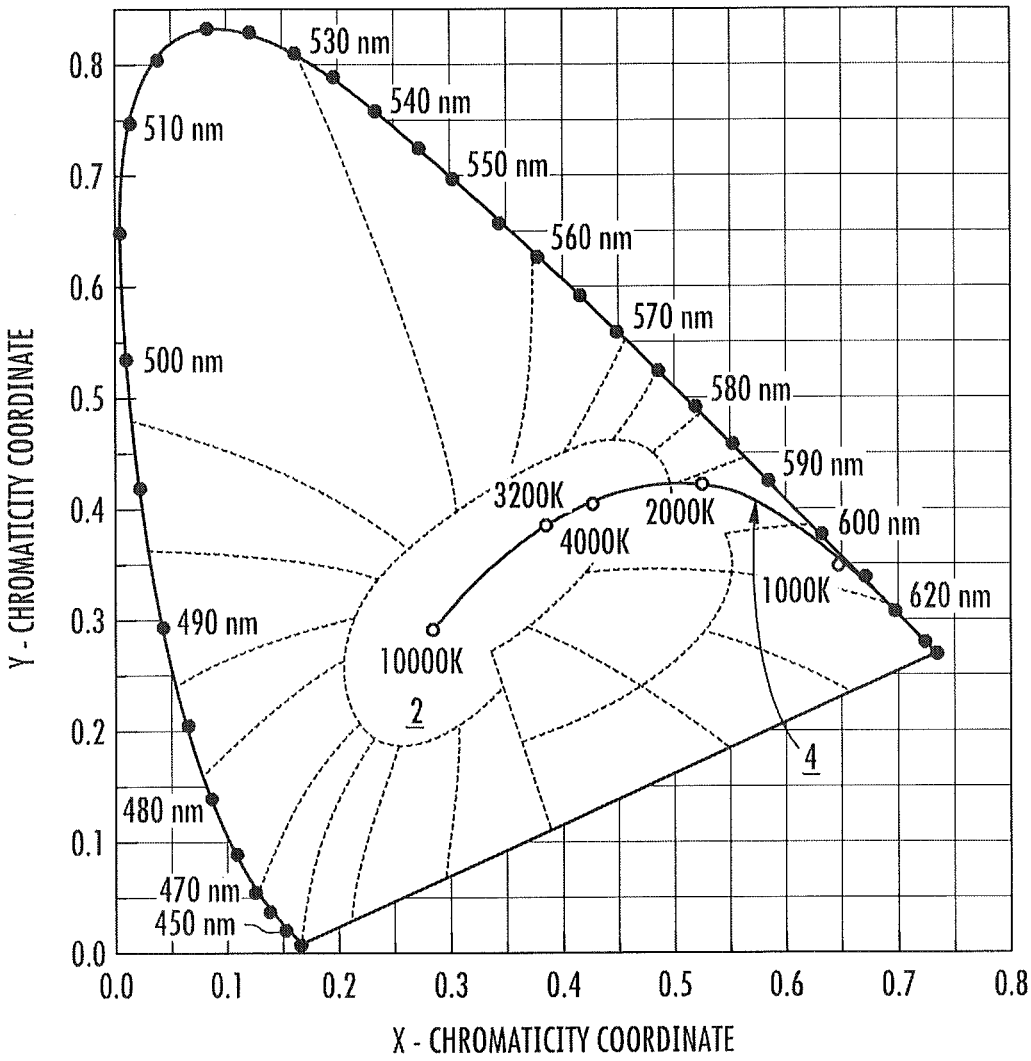
FIG. 1 is a graph of a 1931 CIE Chromaticity Diagram illustrating the location of the black-body locus.

Certain embodiments of the present invention are directed to packaged semiconductor light emitting devices that include multiple "strings" of light emitting devices such as LEDs. Herein, a "string" of light emitting devices refers to a group of at least one light emitting device, such as an LED, that are driven by a common current source. At least some of the light emitting devices in the multiple strings have associated recipient luminophoric mediums that include one or more luminescent materials. At least two of the strings may be independently controllable, which may allow the packaged semiconductor light emitting device to be adjusted to emit light having a desired color. In some embodiments, the device may be adjusted at the factory to emit light of a desired color, while in other embodiments, end users may be provided the ability to select the color of light emitted by the device from a range of different colors.

In some embodiments, the packaged semiconductor light emitting device may include at least blue, green, yellow and red light sources. For example, a device may have three strings of LEDs, where the first string comprises one or more blue LEDs that each have a recipient luminophoric medium that contains a yellow light emitting phosphor, the second string comprises one or more blue LEDs that each have a recipient luminophoric medium that contains a green light emitting phosphor, and the third string comprises one or more red LEDs or, alternatively, one or more blue LEDs that each have a recipient luminophoric medium that contains a red light emitting phosphor.

As used herein, the term "semiconductor light emitting device" may include LEDs, laser diodes and any other light emitting devices that includes one or more semiconductor layers, regardless of whether or not the light emitting devices are packaged into a lamp, fixture or the like. The semiconductor layers included in these devices may include silicon, silicon carbide, gallium nitride and/or other semiconductor materials, an optional semiconductor or non-semiconductor substrate, and one or more contact layers which may include metal and/or other conductive materials. The expression "light emitting device," as used herein, is not limited, except that it be a device that is capable of emitting light.

A packaged semiconductor light emitting device is a device that includes at least one semiconductor light emitting device (e.g., an LED or an LED coated with a recipient luminophoric medium) that is enclosed with packaging elements to provide environmental and/or mechanical protection, light mixing, light focusing or the like, as well as electrical leads, contacts, traces or the like that facilitate electrical connection to an external circuit. Encapsulant material, optionally including luminescent material, may be disposed over the semiconductor light emitting device. Multiple semiconductor light emitting devices may be provided in a single package.

Semiconductor light emitting devices according to embodiments of the invention may include III-V nitride (e.g., gallium nitride) based LEDs fabricated on a silicon carbide, sapphire or gallium nitride substrates such as various devices manufactured and/or sold by Cree, Inc. of Durham, N.C. Such LEDs may (or may not) be configured to operate such that light emission occurs through the substrate in a so-called "flip chip" orientation. These semiconductor light emitting devices may have a cathode contact on one side of the LED, and an anode contact on an opposite side of the LED, or may alternatively have both contacts on the same side of the device. Some embodiments of the present invention may use semiconductor light emitting devices, device packages, fixtures, luminescent materials, power supplies and/or control elements such as described in U.S. Pat. Nos. 7,564,180; 7,456,499; 7,213,940; 7,095,056; 6,958,497; 6,853,010; 6,791,119; 6,600,175, 6,201,262; 6,187,606; 6,120,600; 5,912,477; 5,739,554; 5,631,190; 5,604,135; 5,523,589; 5,416,342; 5,393,993; 5,359,345; 5,338,944; 5,210,051; 5,027,168; 5,027,168; 4,966,862, and/or 4,918,497, and U.S. Patent Application Publication Nos. 2009/0184616; 2009/0080185; 2009/0050908; 2009/0050907; 2008/0308825; 2008/0198112; 2008/0179611, 2008/0173884, 2008/0121921; 2008/0012036; 2007/0253209; 2007/0223219; 2007/0170447; 2007/0158668; 2007/0139923, and/or 2006/0221272. The design and fabrication of semiconductor light emitting devices are well known to those skilled in the art, and hence further description thereof will be omitted.

Visible light may include light having many different wavelengths. The apparent color of visible light to humans can be illustrated with reference to a two-dimensional chromaticity diagram, such as the 1931 CIE Chromaticity Diagram illustrated in FIG. 1. Chromaticity diagrams provide a useful reference for defining colors as weighted sums of colors.

As shown in FIG. 1, colors on a 1931 CIE Chromaticity Diagram are defined by x and y coordinates (i.e., chromaticity coordinates, or color points) that fall within a generally U-shaped area that includes all of the hues perceived by the human eye. Colors on or near the outside of the area are saturated colors composed of light having a single wavelength, or a very small wavelength distribution. Colors on the interior of the area are unsaturated colors that are composed of a mixture of different wavelengths. White light, which can be a mixture of many different wavelengths, is generally found near the middle of the diagram, in the region labeled 2 in FIG. 1. There are many different hues of light that may be considered "white," as evidenced by the size of the region 2. For example, some "white" light, such as light generated by tungsten filament incandescent lighting devices, may appear yellowish in color, while other "white" light, such as light generated by some fluorescent lighting devices, may appear more bluish in color.

Each point in the diagram of FIG. 1 is referred to as the "color point" of a light source that emits a light having that color. As shown in FIG. 1 a locus of color points that is referred to as the "black-body" locus 4 exists which corresponds to the location of color points of light emitted by a black-body radiator that is heated to various temperatures. The black-body locus 4 is also referred to as the "planckian" locus because the chromaticity coordinates (i.e., color points) that lie along the black-body locus obey Planck's equation: $E(\lambda)=A\lambda^{-5}/(e^{B/T}-1)$, where E is the emission intensity, $\lambda$ is the emission wavelength, T is the color temperature of the black-body and A and B are constants. Color coordinates that lie on or near the black-body locus 4 yield pleasing white light to a human observer.

As a heated object becomes incandescent, it first glows reddish, then yellowish, and finally bluish with increasing temperature. This occurs because the wavelength associated with the peak radiation of the black-body radiator becomes progressively shorter with increased temperature, consistent with the Wien Displacement Law. Illuminants that produce light which is on or near the black-body locus 4 can thus be described in terms of their correlated color temperature (CCT). The 1931 CIE Diagram of FIG. 1 includes temperature listings along the black-body locus that show the color path of a black-body radiator that is caused to increase to such temperatures. As used herein, the term "white light" refers to light that is perceived as white, is within 7 MacAdam ellipses of the black-body locus on a 1931 CIE chromaticity diagram, and has a CCT ranging from 2000K to 10,000K. White light with a CCT of 3000K may appear yellowish in color, while white light with a CCT of 8000K or more may appear more bluish in color, and may be referred to as "cool" white light.

"Warm" white light may be used to describe white light with a CCT of between about 2500K and 4500K, which is more reddish or yellowish in color. Warm white light is generally a pleasing color to a human observer. Warm white light with a CCT of 2500K to 3300K may be preferred for certain applications.

The ability of a light source to accurately reproduce color in illuminated objects is typically characterized using the color rendering index ("CRI Ra"). The CRI Ra of a light source is a modified average of the relative measurements of how the color rendition of an illumination system compares to that of a reference black-body radiator when illuminating eight reference colors. Thus, the CRI Ra is a relative measure of the shift in surface color of an object when lit by a particular lamp. The CRI Ra equals 100 if the color coordinates of a set of test colors being illuminated by the illumination system are the same as the coordinates of the same test colors being irradiated by the black-body radiator. Daylight generally has a CRI Ra of nearly 100, incandescent bulbs have a CRI Ra of about 95, fluorescent lighting typically has a CRI Ra of about 70 to 85, while monochromatic light sources have a CRI Ra of essentially zero. Light sources for general illumination applications with a CRI Ra of less than 50 are generally considered very poor and are typically only used in applications where economic issues preclude other alternatives. Light sources with a CRI Ra value between 70 and 80 have application for general illumination where the colors of objects are not important. For some general interior illumination, a CRI Ra value of greater than 80 is acceptable. A light source with color coordinates within 4 MacAdam step ellipses of the black-body locus 4 and a CRI Ra value that exceeds 85 is more suitable for general illumination purposes. Light sources with CRI Ra values of more than 90 provide good color quality.

For backlight, general illumination and various other applications, it is often desirable to provide a lighting source that generates white light having a relatively high CRI Ra, so that objects illuminated by the lighting source may appear to have more natural coloring to the human eye. Accordingly, such lighting sources may typically include an array of semiconductor lighting devices including red, green and blue light emitting devices. When red, green and blue light emitting devices are energized simultaneously, the resulting combined light may appear white, or nearly white, depending on the relative intensities of the red, green and blue sources. However, even light that is a combination of red, green and blue emitters may have a low CRI Ra, particularly if the emitters generate saturated light, because such light may lack contributions from many visible wavelengths.

Pursuant to embodiments of the present invention, semiconductor light emitting devices are provided that may be designed to emit warm white light and to have high CRI Ra values including CRI Ra values that can exceed 90. These devices may also exhibit high luminous power output and efficacy.

In some embodiments, the semiconductor light emitting devices may comprise multi-emitter devices that have one or more light emitting devices that emit radiation in three (or more) different color ranges or regions. By way of example, the semiconductor light emitting device may include a first group of one or more LEDs that combine to emit radiation having a first color point on the 1931 CIE Chromaticity Diagram that falls within a first color range or region, a second group of one or more LEDs that combine to emit radiation having a second color point on the 1931 CIE Chromaticity Diagram that falls within a second color range or region, and a third group of one or more LEDs that combine to emit radiation having a third color point on the 1931 CIE Chromaticity Diagram that falls within a third color range or region.

The drive current that is provided to a first of the groups of LEDs may be adjusted to move the color point of the combined light emitted by the first and second groups of LEDs along a line that extends between the first color point and the second color point. The drive current that is provided to a third of the groups of LEDs may likewise be adjusted to move the color point of the combined light emitted by the first, second and third groups of LEDs along a line that extends between the third color point and the color point of the combined light emitted by the first and second groups of LEDs. By adjusting the drive currents in this fashion the color point of the radiation emitted by the packaged semiconductor light emitting device can be adjusted to a desired color point such as, for example, a color point having a desired color temperature along the black-body locus 4 of FIG. 1. In some embodiments, these adjustments may be performed at the factory and the semiconductor light emitting device may be set at the factory to a desired color point. In other embodiments, end users may be provided the ability to adjust the drive currents provided to one or more of the first, second and third groups of LEDs and thus select a particular color point for the device. The end user may be provided a continuous range of color points to choose between or two or more discrete pre-selected color points.

Figure 2:
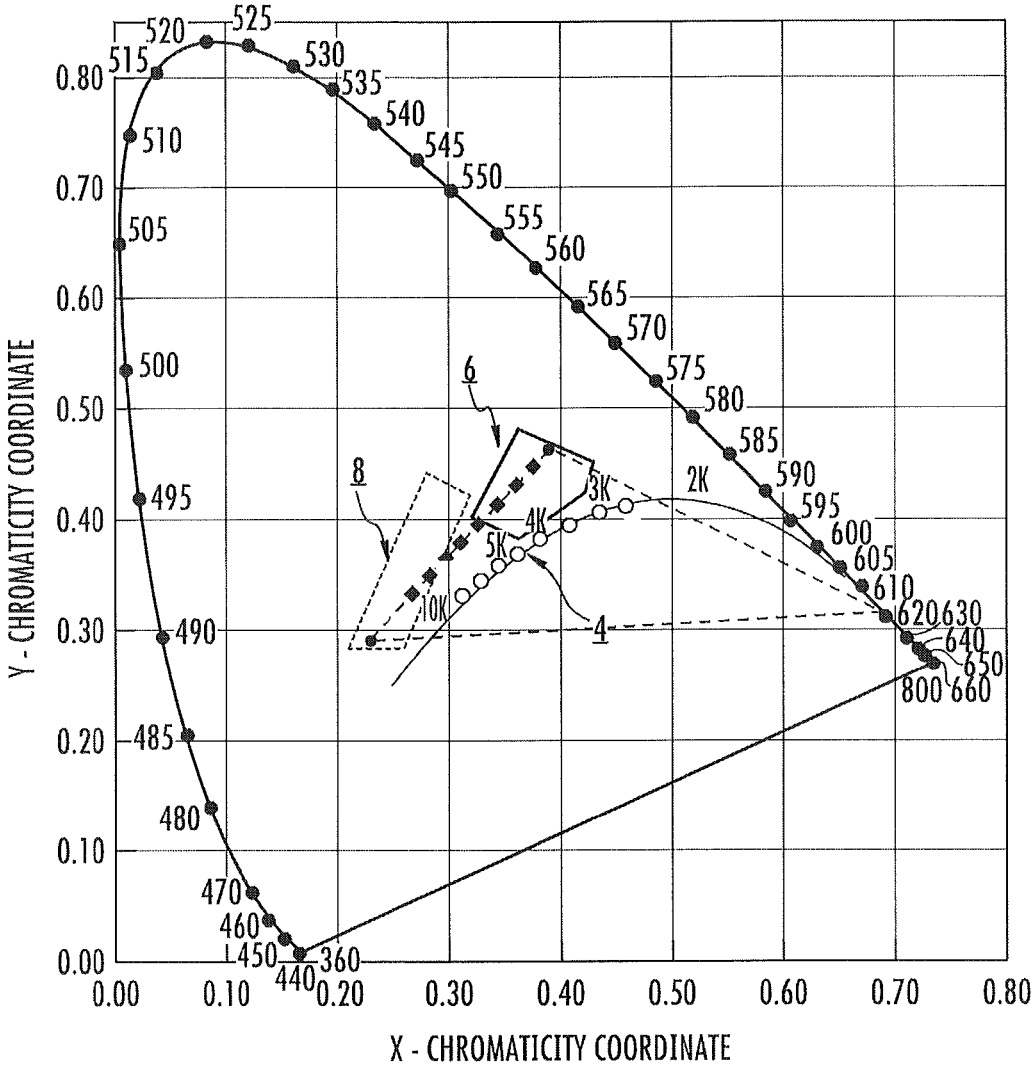
FIG. 2 is another version of the 1931 CIE Chromaticity Diagram that includes trapezoids illustrating color points that may be produced by blue-shifted-yellow and blue-shifted-green LEDs.

In some embodiments, the first group of LEDs may comprise one or more blue-shifted-yellow LEDs ("BSY LED"), and the second group of LEDs may comprise one or more blue-shifted-green LEDs ("BSG LED"). The third group of LEDs may comprise one or more red LEDs (e.g., InAlGaP LEDs) and/or one or more blue-shifted-red LEDs ("BSR LED"). For purposes of this disclosure, a "red LED" refers to an LED that emits nearly saturated radiation having a peak wavelength between 600 and 720 nm, and a "blue LED" refers to an LED that emits nearly saturated radiation having a peak wavelength between 400 and 490 nm. A "BSY LED" refers to a blue LED and an associated recipient luminophoric medium that together emit light having a color point that falls within a trapezoidal "BSY region" on the 1931 CIE Chromaticity Diagram defined by the following x, y chromaticity coordinates: (0.32, 0.40), (0.36, 0.48), (0.43 0.45), (0.36, 0.38), (0.32, 0.40), which is generally within the yellow color range. A "BSG LED" refers to a blue LED and an associated recipient luminophoric medium that together emit light having a color point that falls within a trapezoidal "BSG region" on the 1931 CIE Chromaticity Diagram defined by the following x, y chromaticity coordinates: (0.35, 0.48), (0.26, 0.50), (0.13 0.26), (0.15, 0.20), (0.26, 0.28), (0.35, 0.48), which is generally within the green color range. A "BSR LED" refers to a blue LED that includes a recipient luminophoric medium that emits light having a dominant wavelength between 600 and 720 nm. Typically, the red LEDs and/or BSR LEDs will have a dominant wavelength between 600 and 660 nm, and in most cases between 600 and 640 nm. FIG. 2 is a reproduction of the 1931 CIE Chromaticity Diagram that graphically illustrates the BSY region 6 and the BSG region 8 and shows the locations of the BSY region 6 and the BSG region 8 with respect to the black-body locus 4.

Figure 3:
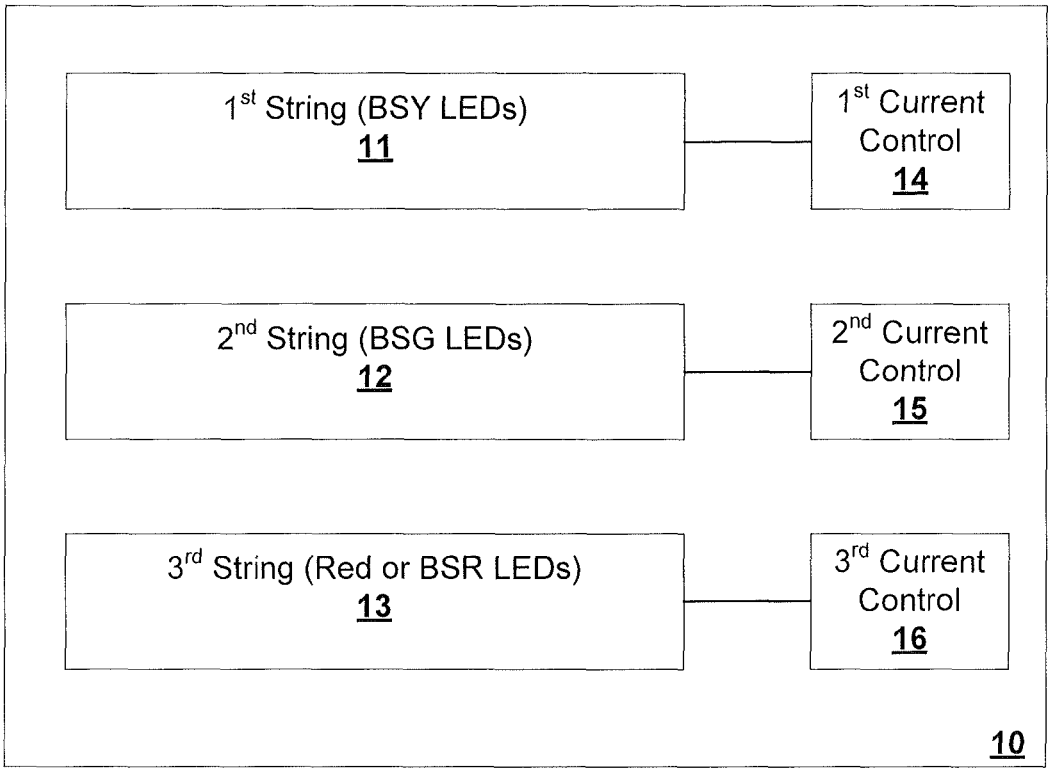
FIG. 3 is a schematic block diagram of a semiconductor light emitting device according to certain embodiments of the present invention.

FIG. 3 is a schematic diagram of a semiconductor light emitting device 10 according to certain embodiments of the present invention.

As shown in FIG. 3, the packaged semiconductor light emitting device 10 includes a first string of light emitting devices 11, a second string of light emitting devices 12, and a third string of light emitting devices 13. In the pictured embodiment, the first string 11 comprises one or more BSY LEDs, the second string 12 comprises one or more BSG LEDs, and the third string 13 comprises one or more red LEDs and/or one or more BSR LEDs. When a string includes multiple LEDs, the LEDs in the string 11, 12, 13 are typically arranged in series, although other configurations are possible.

As further shown in FIG. 3, the semiconductor light emitting device 10 also includes first, second and third current control circuits 14, 15, 16. The first, second and third current control circuits 14, 15, 16 may be configured to provide respective drive currents to the first, second and third strings of LEDs 11, 12, 13. The first, second and third current control circuits 14, 15, 16 may be used to set the drive currents that are provided to the respective first through third strings of LEDs 11, 12, 13 at desired levels. The drive current levels may be selected so that the device 10 will emit combined radiation that has a color point at or near a desired color point. While the device 10 of FIG. 3 includes three current control circuits 14, 15, 16, it will be appreciated in light of the discussion below that other configurations are possible. For example, in other embodiments, one of the current control circuit 14, 15, 16 may be replaced with a non-adjustable drive circuit that provides a fixed drive current to its respective LED string.

Typically, a packaged semiconductor light emitting device such as the device 10 of FIG. 3 will be designed to emit light having a specific color point. This target color point is often on the black-body locus 4 of FIG. 1 and, in such cases, the target color point may be expressed as a particular color temperature along the black-body locus 4. For example, a warm white downlight for residential applications (such downlights are used as replacements for 65 Watt incandescent "can" lights that are routinely mounted in the ceilings of homes) may have a specified color temperature of 3100K, which corresponds to the point labeled "A" on the 1931 CIE Chromaticity Diagram of FIG. 1. Producing light that has this color temperature may be achieved, for example, by selecting some combination of LEDs and recipient luminophoric mediums that together produce light that combines to have the specified color point.

Unfortunately, a number of factors may make it difficult to produce semiconductor light emitting devices that emit light at or near a desired color point. As one example, the plurality of LEDs that are produced by singulating an LED wafer will rarely exhibit identical characteristics. Instead, the output power, peak wavelength, FWHM width and other characteristics of singulated LEDs from a given wafer will exhibit some degree of variation Likewise, the thickness of a recipient luminophoric medium that is coated on an LED wafer or on a singulated LED may also vary, as may the concentration and size distribution of the luminescent materials therein. Such variations will result in variations in the spectral power output of the light emitted by the luminescent materials.

The above-discussed variations (and others) can complicate a manufacturers efforts to produce semiconductor light emitting devices having a pre-selected color point. By way of example, if a particular semiconductor light emitting device is designed to use blue LEDs having a peak wavelength of 460 nm in order to achieve a specified color temperature along the black-body locus 4 of FIG. 1, then an LED wafer that is grown to provide 460 nm LED chips may only produce a relatively small quantity of 460 nm LED chips, with the remainder of the wafer producing LEDs having peak wavelengths at a distribution around 460 nm (e.g., 454 to 464 nm). If a manufacturer wants to remain very close to the desired color point, it may decide to only use LED chips that have a peak wavelength of 460 nm or only use LEDs having peak wavelengths that are very close to 460 nm (e.g., 459 to 461 nm). If such a decision is made, then the manufacturer will need to grow or purchase a larger number of LED wafers to obtain the necessary number of LEDs that have peak wavelengths within the acceptable range, and will also need to find markets for the LEDs that have peak wavelengths outside the acceptable range.

In order to reduce the number of LED wafers that must be grown or purchased, an LED manufacturer can, for example, increase the size of the acceptable range of peak wavelengths by selecting LEDs on opposite sides of the specified peak wavelength. By way of example, if a particular design requires LEDs having a peak wavelength of 460 nm, then use of LEDs having peak wavelengths of 457 nm and 463 nm may together produce light that is relatively close to the light emitted by an LED from the same wafer that has a peak wavelength of 460 nm. Thus, a manufacturer can "blend" multiple LEDs together to produce the equivalent of the desired LED. A manufacturer may use similar "blending" techniques with respect o variations in the output power of LEDs, FWHM width and various other parameters. As the number of parameters is increased, the task of determining combinations of multiple LEDs (and luminescent materials) that will have a combined color point that is close to a desired color point can be a complex undertaking.

Pursuant to embodiments of the present invention, methods of tuning a semiconductor light emitting device are provided that can be used to adjust the light output thereof such that the emitted light is at or near a desired color point. Pursuant to these methods, the current provided to at least two different strings of light emitting devices that are included in the device may be separately adjusted in order to set the color point of the device at or near a desired value. These methods will now be described with respect to FIG. 4, which is a reproduction of the 1931 CIE Chromaticity Diagram that includes annotations illustrating how the device 10 of FIG. 3 may be tuned to emit light having a color point at or near a desired color point.

Figure 4:
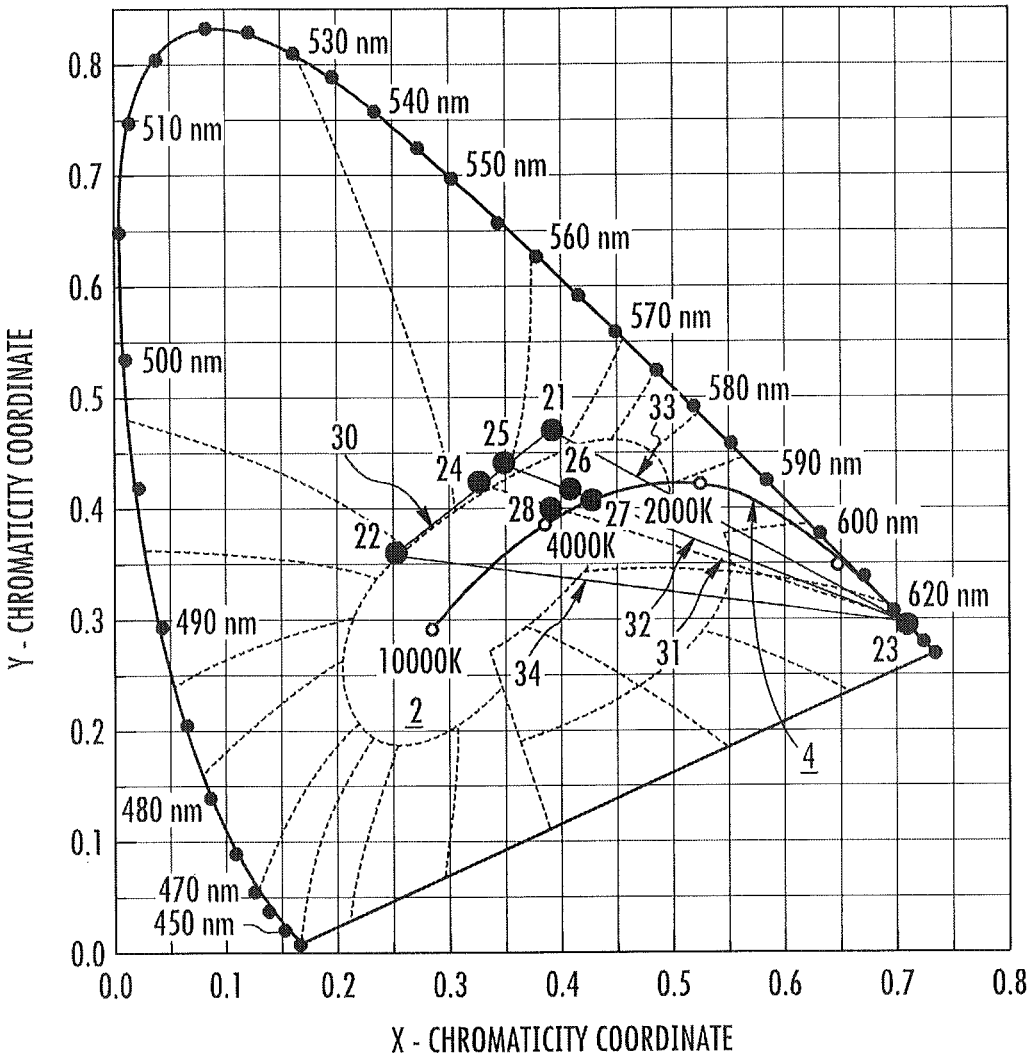
FIG. 4 is an annotated version of the 1931 CIE Chromaticity Diagram that illustrates how a light emitting device can be tuned to achieve a desired color point along the black-body locus according to certain embodiments of the present invention.

Referring to FIGS. 3 and 4, a point labeled 21 on the graph of FIG. 4 represents the color point of the combined light output of the first string of BSY LEDs 11, a point labeled 22 represents the color point of the combined light output of the second string of BSG LEDs 12, and a point labeled 23 represents the color point of the combined light output of the third string of red or BSR LEDs 13. The points 21 and 22 define a first line 30. The light emitted by the combination of the first string of BSY LEDs 11 and the second string of BSG LEDs 12 will be a color point along line 30, with the location of the color point dependent upon the relative intensities of the combined light output by the first string of BSY LEDs 11 and the combined light output by the second string of BSG LEDs 12. Those intensities, in turn, are a function of the drive currents that are supplied to the first and second strings 11, 12. For purposes of this example, it has been assumed that the first string 11 has a slightly higher intensity of light output than the second string 12. Based on this assumption, a point labeled 24 is provided on the graph of FIG. 4 that represents the color point of the light emitted by the combination of the first string of BSY LEDs 11 and the second string of BSG LEDs 12.

The color point of the overall light output of the device 10 will fall on a line 31 in FIG. 4 that extends between the color point of the combined light output of the third string of red or BSR LEDs 13 (i.e., point 23) and the color point of the combination of the light emitted by the first string of BSY LEDs 11 and the second string of BSG LEDs 12 (i.e., point 24). The exact location of that color point on line 31 will depend on the relative intensity of the light emitted by the strings 11 and 12 versus the intensity of the light emitted by string 13. In FIG. 4, the color point of the overall light output of the device 10 is labeled 28.

The device 10 may be designed, for example, to have a color point that falls on the point on the black-body locus 4 that corresponds to a color temperature of 3200K (this color point is labeled as point 27 in FIG. 4). However, due to manufacturing variations, blending and various other factors, the manufactured device may not achieve the designed color point, as is shown graphically in FIG. 4 where the point 28 that represents the color point of the manufactured device is offset by some distance from the black-body locus 4, and is near the point on the black-body locus corresponding to a correlated color temperature of 3800K as opposed to the desired color temperature of 3200K. Pursuant to embodiments of the present invention, the device 10 may be tuned to emit light that is closer to the desired color point 27 by adjusting the relative drive currents provided to the strings 11, 12, 13.

For example, pursuant to some embodiments, the color point of the light emitted by the combination of the first string of BSY LEDs 11 and the second string of BSG LEDs 12 may be moved along line 30 of FIG. 4 by adjusting the drive currents provided to one or both of BSY LED string 11 and BSG LED string 12. In particular, if the drive current provided to BSY LED string 11 is increased relative to the drive current supplied to BSG LED string 12, then the color point will move to the right from point 24 along line 30. If, alternatively, the drive current provided to BSY LED string 11 is decreased relative to the drive current supplied to BSG LED string 12, then the color point will move from point 24 to the left along line 30. In order to tune the device 10 to emit light having a color temperature of 3200K, the drive current provided to BSY LED string 11 is thus increased relative to the drive current supplied to BSG LED string 12 in an amount that moves the color point of the combined light emitted by BSY LED string 11 and BSG LED string 12 from point 24 to the point labeled 25 on line 30 of FIG. 4. As a result of this change, the color point of the overall light output by the device 10 moves from point 28 to point 26 on FIG. 4.

Next, the device 10 may be further tuned by adjusting the relative drive current provided to string 13 as compared to the drive currents provided to strings 11 and 12. In particular, the drive current provided to string 13 is increased relative to the drive current supplied to strings 11, 12 so that the light output by device 10 will move from color point 26 to the right along a line 32 that extends between point 23 and point 25 to point 27, thereby providing a device that outputs light having a color temperature of 3200K on the black-body locus 4. Thus, the above example illustrates how the drive current to the LED strings 11, 12, 13 can be tuned so that the device 10 outputs light at or near a desired color point. Such a tuning process may be used to reduce or eliminate deviations from a desired color point that result from, for example manufacturing variations in the output power, peak wavelength, phosphor thicknesses, phosphor conversion ratios and the like.

It will be appreciated in light of the discussion above that if a semiconductor light emitting device that includes independently controllable light sources that emit light at three different color points, then it may be theoretically possible to tune the device to any color point that falls within the triangle defined by the color points of the three light sources. Moreover, by selecting light sources having color points that fall on either side of the black-body locus 4, it may become possible to tune the device to a wide variety of color points along the black-body locus 4.

Figure 5A:
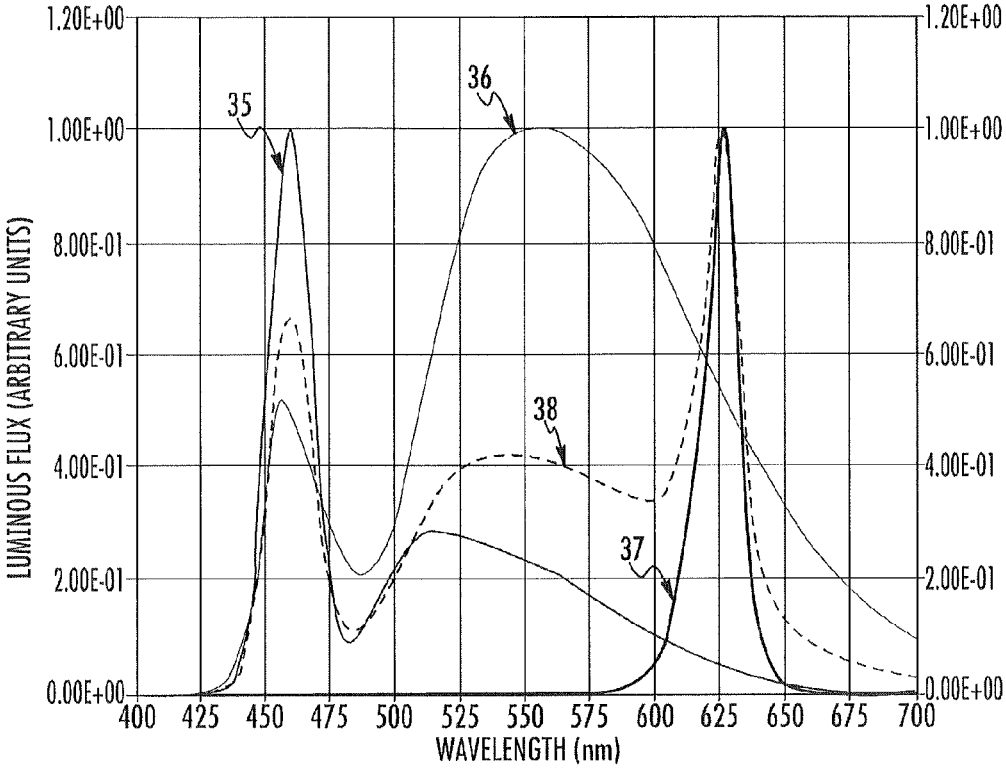
FIGS. 5A and 5B are graphs of the simulated spectral power distribution of a semiconductor light emitting device according to embodiments of the present invention.
Figure 5B:
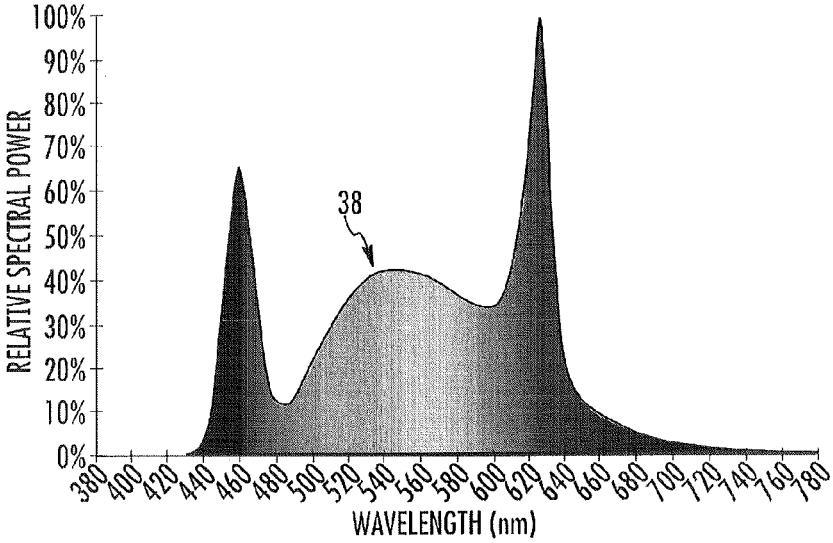

FIGS. 5A and 5B are graphs illustrating the simulated spectral power distribution of the semiconductor light emitting device having the general design of device 10 of FIG. 3. Curves 35, 36 and 37 of FIG. 5A illustrate the simulated contributions of each of the three LED strings 11, 12, 13 of the device 10, while curve 38 illustrates the combined spectral output of all three strings 11, 12, 13. Each of curves 35, 36, 37 are normalized to have the same peak luminous flux. Curve 35 illustrates that the BSY LED string 11 emits light that is a combination of blue light from the blue LED(s) that is not converted by the recipient luminophoric medium(s) associated with the blue LED(s) and light having a peak wavelength in the yellow color range that is emitted by luminescent materials in those recipient luminophoric medium(s). Curve 36 similarly illustrates that the BSG LED string 12 emits light that is a combination of blue light from the blue LED(s) that is not converted by the recipient luminophoric medium(s) associated with the blue LED(s) and light having a peak wavelength in the green color range that is emitted by luminescent materials in those recipient luminophoric medium(s). Curve 37 illustrates that the red LED string 13 emits nearly saturated light having a peak wavelength of about 628 nm.

FIG. 5B illustrates curve 38 of FIG. 5A in a slightly different format. As noted above, curve 38 shows the luminous flux output by the device 10 of FIG. 3 as a function of wavelength. As shown in FIG. 5B, the light output by the device includes fairly high, sharp peaks in the blue and red color ranges, and a somewhat lower and broader peak that extends across the green, yellow and orange color ranges.

While the graph of FIG. 5B shows that the device 10 has significant output across the entire visible color range, a noticeable valley is present in the emission spectrum in the "cyan" color range that falls between the blue and green color ranges. For purposes of the present disclosure, the cyan color range is defined as light having a peak wavelength between 490 nm and 515 nm. Pursuant to additional embodiments of the present invention, semiconductor light emitting devices are provided that include one or more additional LEDs that "fill-in" this gap in the emission spectrum. Such devices may, in some cases, exhibit improved CRI Ra performance as compared to the device 10 of FIG. 3.

Figure 6:
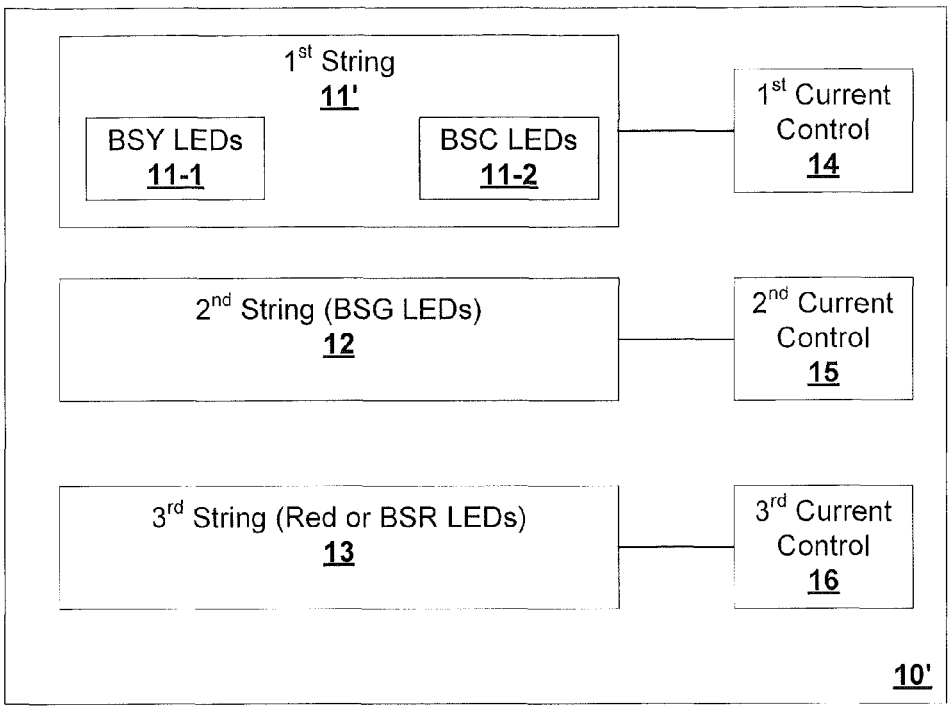
FIG. 6 is a schematic block diagram of a semiconductor light emitting device according to further embodiments of the present invention.

By way of example, FIG. 6 is a schematic block diagram of another semiconductor light emitting device 10' according to embodiments of the present invention. As can be seen by comparing FIGS. 3 and 6, the device 10' is identical to the device 10 of FIG. 3, except that the BSY LED string 11 of FIG. 3 is replaced with a string of LEDs 11' that includes one or more BSY LEDs 11-1 and one or more LEDs that emit light having a peak wavelength in the cyan color range 11-2. In the depicted embodiment, the LEDs 11-2 that emit light having a peak wavelength in the cyan color range are blue-shifted-cyan ("BSC") LEDs 11-2 that each comprise a blue LED that includes a recipient luminophoric medium that emits light having a dominant wavelength between 490 and 515 nm. The BSC LEDs 11-2 may help fill-in the above-referenced valley in the emission spectrum that would otherwise exist in the region between the blue peak that is formed by the emission from the blue LEDs in strings 11' and 12 that is not converted by the recipient luminophoric mediums included on those LEDs and the emission of the phosphors in the recipient luminophoric mediums included on the BSG LEDs 12. As such, the CRI Ra value of the device may be increased.

It will be appreciated that many modifications can be made to the above-described semiconductor light emitting devices according to embodiments of the present invention, and to methods of operating such devices. For example, the device 10' of FIG. 6 could be modified so that the BSC LEDs 11-2 were included as part of the BSG LED string 12 or the red LED string 13 instead of as part of the BSY LED string 11'. In still other embodiments, the BSC LEDs 11-2 could be part of a fourth independently controlled string (which fourth string could have a fixed or independently adjustable drive current). In any of these embodiments, the BSC LEDs 11-2 could be replaced or supplemented with one or more long blue wavelength LEDs that emit light having a peak wavelength between 471 nm and 489 nm.

It will also be appreciated that all of the strings 11, 12 and 13 need not be independently controllable in order to tune the device 10 (or the device 10' or other modified devices described herein) in the manner described above, For example, FIG. 7 illustrates a device 10" that is identical to the device 10 of FIG. 3, except that in device 10, the second string control circuit 15 is replaced by a fixed drive circuit 15' that supplies a fixed drive current to the second BSG LED string 12. The color point of the combined output of the BSY LED string 11 and the BSG LED string 12 of device 10" is adjusted by using the first current control circuit 14 to increase or decrease the drive current provided to the BSY LED string 11 in order to move the color point of the combined output of the strings 11, 12 along the first line 30 of FIG. 4. However, it will be appreciated that independent control of all three strings 11, 12, 13 may be desired in some applications as this may allow the device to be tuned such that the output power of the device is maintained at or near a constant level during the tuning process.

It will further be appreciated that in other embodiments the tuning process need not start by adjusting the relative drive currents supplied to the BSY LED string 11 and the BSG LED string 12. For example, in another embodiment, the relative drive currents supplied to the BSY LED string 11 and the red LED string 13 may be adjusted first (which moves the color point for the overall light output of the device along a line 33 of FIG. 4), and then the relative drive current supplied to the BSG string 12 as compared to the drive currents supplied to the BSY LED string 11 and the red LED string 13 may be adjusted to move the color point of the device to a desired location. Similarly, in still another embodiment, the relative drive currents supplied to the BSG LED string 12 and the red LED string 13 may be adjusted first (which moves the color point for the overall light output of the device along a line 34 of FIG. 4), and then the relative drive current supplied to the BSY string 11 as compared to the drive currents supplied to the BSG LED string 12 and the red LED string 13 may be adjusted to move the color point of the device to a desired location.

It will likewise be appreciated that if more than three strings of LEDs are provided, an additional degree of freedom may be obtained in the tuning process. For example, if a fourth string of BSC LEDs was added to the device 10 of FIG. 3, then the device 10 could be tuned to a particular color point by appropriately adjusting any two of the four strings relative to the other strings.

It will likewise be appreciated that embodiments of the present invention are not limited to semiconductor devices that include BSY and BSG LEDs. For example, in other embodiments, LEDs that emit radiation in the ultraviolet range may be used in conjunction with appropriate recipient luminophoric mediums. In one such embodiment, the device could include a first string of ultraviolet LEDs could have recipient luminophoric mediums that emit light in a blue color range (i.e., 400 to 490 nm), a second string of ultraviolet LEDs could have recipient luminophoric mediums that emit light in a green color range (i.e., 500 to 570 nm), a third string of ultraviolet LEDs could have recipient luminophoric mediums that emit light in the yellow color range (i.e., 571 to 599 nm), and a fourth string of orange and/or red. It will also be appreciated, that luminescent materials that emit in color ranges other than yellow and green may be used (e.g., the BSG LEDs could be replaced with BSC LEDs). It will also be appreciated that luminescent materials may be used that emit light having a peak wavelength in the green or yellow color range that fall outside the definitions of BSG and BSY LEDs as those terms are defined herein. Thus, it will be appreciated that the above-described embodiments are exemplary in nature and do not limit the scope of the present invention.

Figure 7:
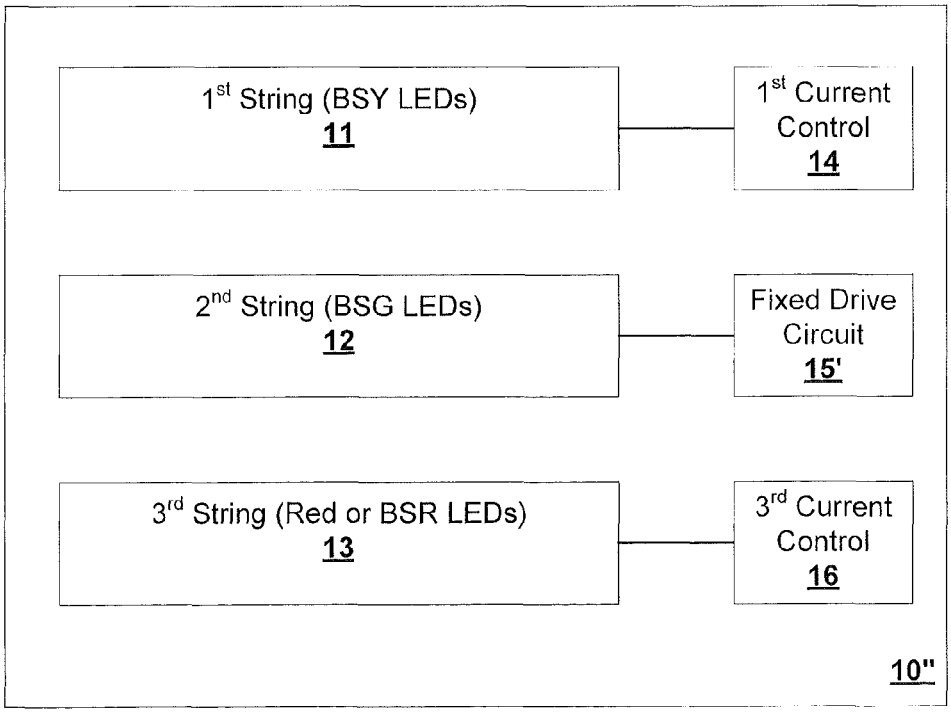
FIG. 7 is a schematic block diagram of a semiconductor light emitting device according to additional embodiments of the present invention.

In some embodiments, the LEDs in the third string 13 of FIGS. 3, 6 and 7 may emit light having a dominant wavelength between 600 nm and 635 nm, or even within a range of between 610 nm and 625 nm. Likewise, in some embodiments, the blue LEDs that are used to form the BSY and/or BSG LEDs of strings 11 and 12 of FIGS. 3, 6 and 7 may have peak wavelengths that are between about 430 nm and 480 nm, or even within a range of between 440 nm and 475 nm. In some embodiments, the BSG LEDs may comprise a blue LED that emits radiation having a peak wavelength between 440 and 475 nm and an associated recipient luminophoric medium that together emit light having a color point that falls within the region on the 1931 CIE Chromaticity Diagram defined by the following x, y chromaticity coordinates: (0.21, 0.28), (0.26, 0.28), (0.32 0.42), (0.28, 0.44), (0.21, 0.28).

FIG. 8A is a table that lists design details for eight semiconductor light emitting devices according to embodiments of the present invention. FIG. 8B is a table that provides information regarding the simulated spectral emissions of each of the eight devices of FIG. 8A.

As shown in FIG. 8A, eight semiconductor light emitting devices were designed that each had the basic configuration of the device 10 of FIG. 3 in that they included a string of BSY LEDs, a string of BSG LEDs and a string of red LEDs. These devices were designed to have target correlated color temperatures of 2700K, 3000K, 3500K, 4000K, 4500K, 5500K, 5700K and 6500K, respectively, on the black body locus 4 of FIG. 1. In the table of FIG. 8A, the column labeled "Trapezoid" provides the (x,y) color coordinates on the 1931 CIE Chromaticity Diagram that define a trapezoid around the target color point that would be considered acceptable for each particular design, the column labeled "Center Point" provides the coordinates of the center of this trapezoid, and the column labeled "Center Point CCT" provides the correlated color temperature of the center point.

FIG. 8B provides information regarding the simulated spectral emissions of each of the eight devices of FIG. 8A. As shown in FIG. 8B, these simulations indicate that all of the devices should provide a CRI Ra of 94 or greater, which represents excellent color rendering performance. Additionally, the luminous efficacy of each device varies between 310 and 344 Lum/W-Optical, which again represents excellent performance. FIG. 8B also breaks down the simulated contribution of each of the BSY LED, BSG LED and red LED strings 11, 12, 13 to the overall luminous output of the device. As can be seen, the red and yellow contributions decrease with increasing correlated color temperature. Finally, FIG. 8B also provides the color coordinates of the combined light output by BSY LED string 11 and BSG LED string 12.

Figure 9A:
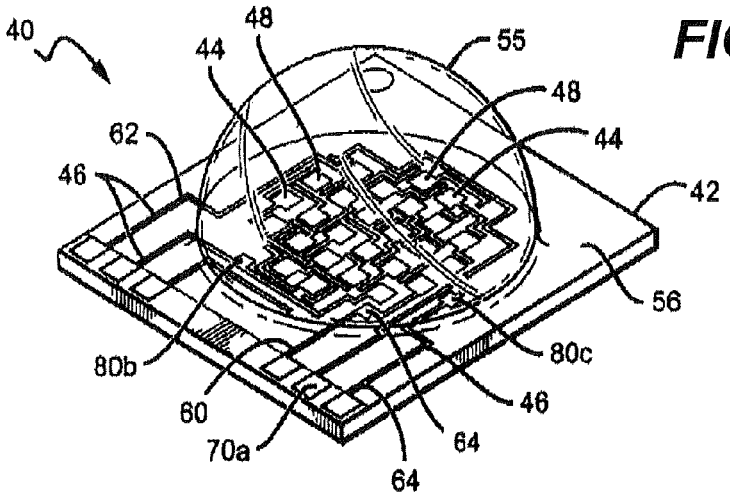
FIGS. 9A-E are various views of a packaged semiconductor light emitting device according to certain embodiments of the present invention.
Figure 9B:
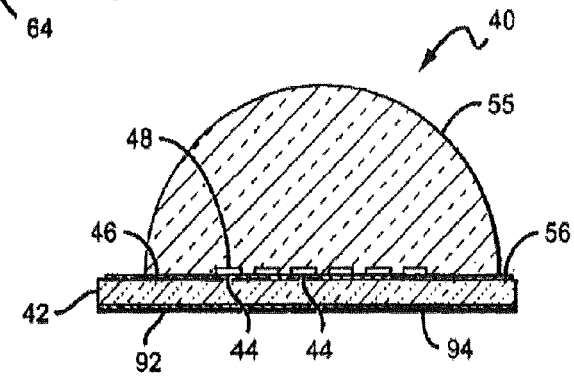
Figure 9C:
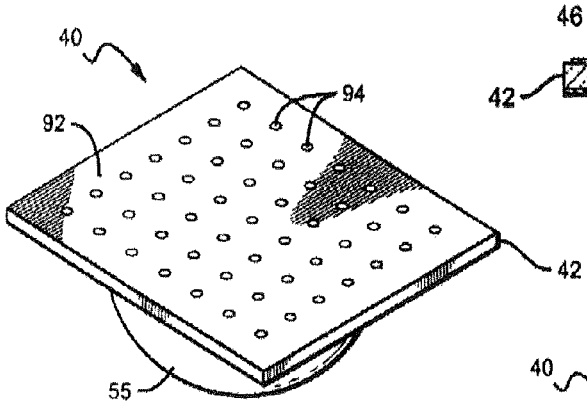
Figure 9D:
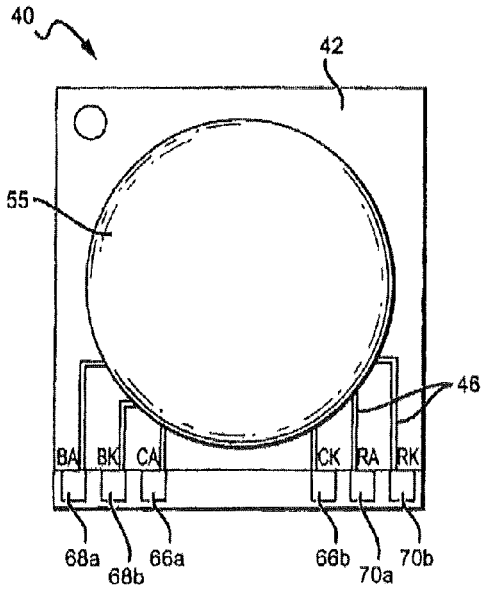
Figure 9E:
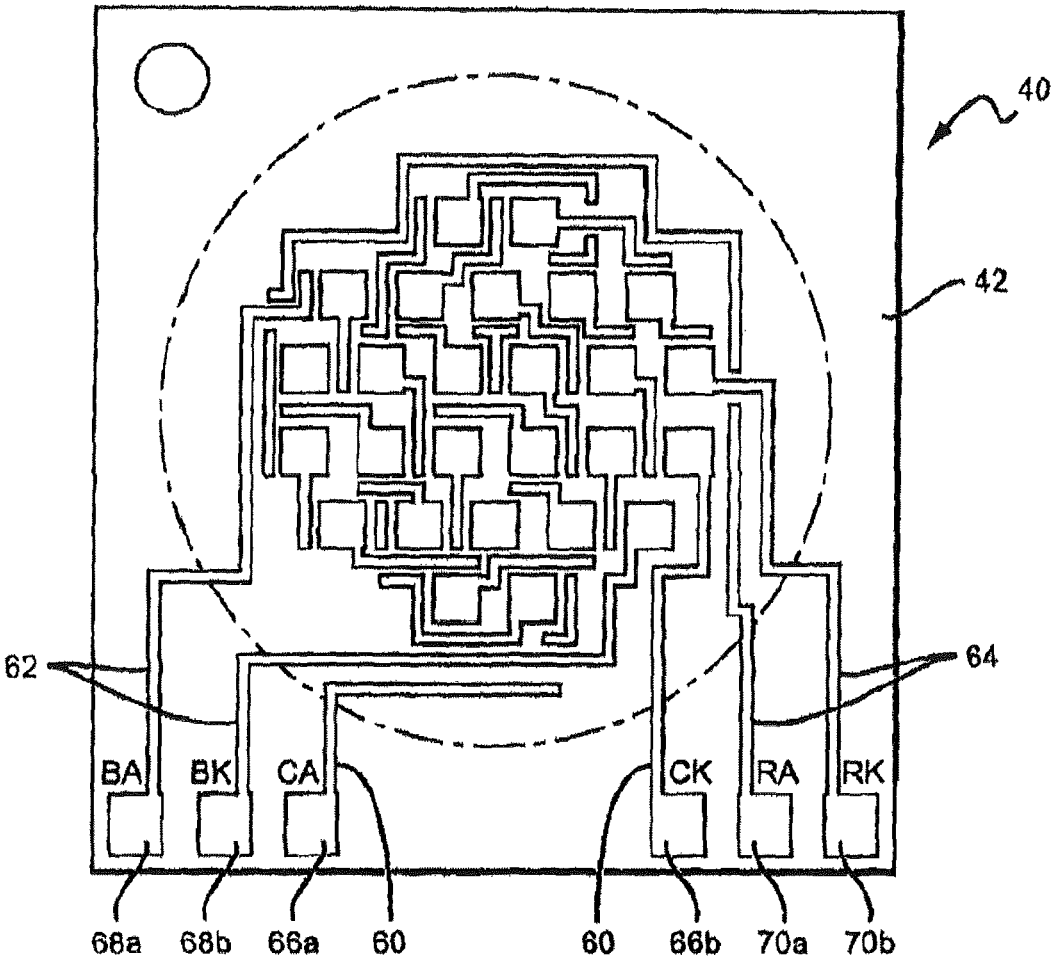

A packaged semiconductor light emitting device 40 according to embodiments of the present invention will now be described with reference to FIGS. 9A-E. FIG. 9A is a top perspective view of the device 40. FIG. 9B is a side cross-sectional view of the device 40. FIG. 9C is a bottom perspective view of the device 40. FIG. 9D is a top plan view of the device 40. FIG. 9E is a top plan view of a die attach pad and interconnect trace arrangement for the device 40.

As shown in FIG. 9A, the device 40 includes a submount 42 that supports an array of LEDs 48. The submount 40 can be formed of many different materials including either insulating materials, conductive materials or a combination thereof. For example, the submount 42 may be formed of alumina, aluminum oxide, aluminum nitride, silicon carbide, organic insulators, sapphire, copper, aluminum, steel, other metals or metal alloys, silicon, or of a polymeric material such as polyimide, polyester, etc. In some embodiments, the submount 42 may comprise a printed circuit board (PCB), which may facilitate providing electrical connections to and between the LEDs 48. Portions of the submount 42 may include or be coated with a high reflective material, such as reflective ceramic or metal (e.g., silver) to enhance light extraction from the packaged device 40.

Each LED 48 is mounted to a respective die pad 44 that is provided on the top surface of the submount 42. Conductive traces 46 are also provided on the top surface of the submount 42. The die pads 44 and conductive traces 46 can comprise many different materials such as metals (e.g., copper) or other conductive materials, and may be deposited, for example, via plating and patterned using standard photolithographic processes. Seed layers and/or adhesion layers may be provided beneath the die pads 44. The die pads 44 may also include or be plated with reflective layers, barrier layers and/or dielectric layers. The LEDs 48 may be mounted to the die pads 44 using conventional methods such as soldering.

In some embodiments, the LEDs 48 may include one or more BSY LEDs, one or more BSG LEDs and one or more saturated red LEDs. In other embodiments, some or all of the saturated red LEDs may be replaced with BSR LEDs. Moreover, additional LEDs may be added, including, for example, one or more long-wavelength blue LEDs and/or BSC LEDs. LED structures, features, and their fabrication and operation are generally known in the art and only briefly discussed herein.

Each LED 48 may include at least one active layer/region sandwiched between oppositely doped epitaxial layers. The LEDs 48 may be grown as wafers of LEDs, and these wafers may be singulated into individual LED dies to provide the LEDs 48. The underlying growth substrate can optionally be fully or partially removed from each LED 48. Each LED 48 may include additional layers and elements including, for example, nucleation layers, contact layers, current spreading layers, light extraction layers and/or light extraction elements. The oppositely doped layers can comprise multiple layers and sub-layers, as well as super lattice structures and interlayers. The active region can include, for example, single quantum well (SQW), multiple quantum well (MQW), double heterostructure and/or super lattice structures. The active region and doped layers may be fabricated from various material systems, including, for example, Group-III nitride based material systems such as GaN, aluminum gallium nitride (AlGaN), indium gallium nitride (InGaN) and/or aluminum indium gallium nitride (AlInGaN). In some embodiments, the doped layers are GaN and/or AlGaN layers, and the active region is an InGaN layer.

Each LED 48 may include a conductive current spreading structure on its top surface, as well as one or more contacts/bond pads that are accessible at its top surface for wire bonding. The current spreading structure and contacts/bond pads can be made of a conductive material such as Au, Cu, Ni, In, Al, Ag or combinations thereof, conducting oxides and transparent conducting oxides. The current spreading structure may comprise spaced-apart conductive fingers that are arranged to enhance current spreading from the contacts/bond pads into the top surface of its respective LED 48. In operation, an electrical signal is applied to a contact/bond pad through a wire bond, and the electrical signal spreads through the fingers of the current spreading structure into the LED 48.

Some or all of the LEDs 48 may have an associated recipient luminophoric medium that includes one or more luminescent materials. Light emitted by a respective one of the LEDs 48 may pass into its associated recipient luminophoric medium. At least some of that light that passes into the recipient luminophoric medium is absorbed by the luminescent materials contained therein, and the luminescent materials emit light having a different wavelength distribution in response to the absorbed light. The recipient luminophoric medium may fully absorb the light emitted by the LED 48, or may only partially absorb the light emitted by the LED 48 so that a combination of unconverted light from the LED 48 and down-converted light from the luminescent materials is output from the recipient luminophoric medium. The recipient luminophoric medium may be coated directly onto the LED or otherwise disposed to receive some or all of the light emitted by its respective LED 48. It will also be appreciated that a single recipient luminophoric medium may be used to down-convert some or all of the light emitted by multiple of the LEDs 48. By way of example, in some embodiments, each string of LEDs 48 may be included in its own package, and a common recipient luminophoric medium for the LEDs 48 of the string may be coated on a lens of the package or included in an encapsulant material that is disposed between the lens and the LEDs 48.

The above-described recipient luminophoric mediums may include a single type of luminescent material or may include multiple different luminescent materials that absorb some of the light emitted by the LEDs 48 and emit light in a different wavelength range in response thereto. The recipient luminophoric mediums may comprise a single layer or region or multiple layers or regions, which may be directly adjacent to each other or spaced-apart. Suitable methods for applying the recipient luminophoric mediums to the LEDs 48 include the coating methods described in U.S. patent application Ser. Nos. 11/656,759 and 11/899,790, the electrophoretic deposition methods described in U.S. patent application Ser. No. 11/473,089, and/or the spray coating methods described in U.S. patent application Ser. No. 12/717,048. Numerous other methods for applying the recipient luminophoric mediums to the LEDs 48 may also be used.

As noted above, in certain embodiments, the LEDs 48 can include at least one BSY LED, at least one BSG LED, and at least one red light source. The BSY LED(s) may comprise blue LEDs that include a recipient luminophoric medium that has YAG:Ce phosphor particles therein such that the LED and phosphor particles together emit a combination of blue and yellow light. In other embodiments, different yellow light emitting luminescent materials may be used to form the BSY LEDs including, for example, phosphors based on the $(Gd, Y)_3(Al, Ga)_5O_{12}$:Ce system, such as $Y_3Al_5O_{12}$:Ce (YAG) phosphors; $Tb_{3-x}RE_xO_{12}$:Ce (TAG) phosphors where RE=Y, Gd, La, Lu; and/or $Sr_{2-x-y}Ba_xCa_ySiO_4$:Eu phosphors. The BSG LED(s) may comprise blue LEDs that have a recipient luminophoric medium that include LuAG:Ce phosphor particles such that the LED and phosphor particles together emit a combination of blue and green light. In other embodiments, different green light emitting luminescent materials may be used including, for example, $(Sr,Ca,Ba)(Al,Ga)_2S_4$: $Eu^{2+}$ phosphors; $Ba_2(Mg,Zn)Si_2O_7$: $Eu^{2+}$ phosphors; $Gd_{0.46}Sr_{0.31}Al_{1.23}O_xF_{1.38}$:$Eu^{2+}{}_{0.06}$ phosphors; $(Ba_{1-x-y}Sr_xCa_y)SiO_4$:Eu phosphors; $Ba_xSiO_4$:$Eu^{2+}$ phosphors;

$Sr_6P_5BO_{20}$:Eu phosphors; $MSi_2O_2N_2:Eu^{2+}$ phosphors; and/or Zinc Sulfide:Ag phosphors with (Zn,Cd)S:Cu:Al. In some embodiments, the BSG LEDs may employ a recipient luminescent medium that includes a green luminescent material that has a FWHM emission spectrum that falls at least in part into the cyan color range (and in some embodiments, across the entire cyan color range) such as, for example, a LuAG:Ce phosphor that has a peak emission wavelength of between 535 and 545 nm and a FWHM bandwidth of between about 110-115 nm. The at least one red light source may comprise BSG LEDs and/or red LEDs such as, for example, conventional AlInGaP LEDs. Suitable luminescent materials for the BSR LEDs (if used) include $Lu_2O_3:Eu^{3+}$ phosphors; $(Sr_{2-x}La_x)(Ce_{1-x}Eu_x)O_4$ phosphors; $Sr_2Ce_{1-x}Eu_xO_4$ phosphors; $Sr_{2-x}Eu_xCeO_4$ phosphors; $SrTiO_3:Pr^{3+},Ga^{3+}$ phosphors; $(Ca_{1-x}Sr_x)SiAlN_3:Eu^{2+}$ phosphors; and/or $Sr_2Si_5N_8:Eu^{2+}$ phosphors. It will be understood that many other phosphors can used in combination with desired solid state emitters (e.g., LEDs) to achieve the desired aggregated spectral output.

An optical element or lens 55 may be provided over the LEDs 48 to provide environmental and/or mechanical protection. In some embodiments the lens 55 can be in direct contact with the LEDs 48 and a top surface of the submount 42. In other embodiments, an intervening material or layer may be provided between the LEDs 48 and the top surface of the submount 42. The lens 55 can be molded using different molding techniques such as those described in U.S. patent application Ser. No. 11/982,275. The lens 55 can be many different shapes such as, for example, hemispheric, ellipsoid bullet, flat, hex-shaped, and square, and can be formed of various materials such as silicones, plastics, epoxies or glass. The lens 55 can be textured to improve light extraction. For a generally circular LED array, the diameter of the lens can be approximately the same as or larger than the diameter of the LED array.

The lens 55 may also include features or elements arranged to diffuse or scatter light, including scattering particles or structures. Such particles may include materials such as titanium dioxide, alumina, silicon carbide, gallium nitride, or glass micro spheres, with the particles preferably being dispersed within the lens. Alternatively, or in combination with the scattering particles, air bubbles or an immiscible mixture of polymers having a different index of refraction could be provided within the lens or structured on the lens to promote diffusion of light. Scattering particles or structures may be dispersed homogeneously throughout the lens 55 or may be provided in different concentrations or amounts in different areas in or on a lens. In one embodiment, scattering particles may be provided in layers within the lens, or may be provided in different concentrations in relation to the location of LEDs 48 (e.g., of different colors) within the packaged device 40. In other embodiments, a diffuser layer or film (not shown) may be disposed remotely from the lens 55 at a suitable distance from the lens 55, such as, for example, 1 mm, 5 mm, 10 mm, 20 mm, or greater. The diffuser film may be provided in any suitable shape, which may depend on the configuration of the lens 55. A curved diffuser film may be spaced apart from but conformed in shape to the lens and provided in a hemispherical or dome shape.

The LED package 40 may include an optional protective layer 56 covering the top surface of the submount 42, e.g., in areas not covered by the lens 55. The protective layer 56 provides additional protection to the elements on the top surface to reduce damage and contamination during subsequent processing steps and use. The protective layer 56 may be formed concurrently with the lens 55, and optionally comprise the same material as the lens 55.

As shown in FIGS. 9D-E, the packaged device 40 includes three contact pairs 66*a*-66*b*, 68*a*-68*b*, 70*a*-70*b* that provide external electrical connections. Three current control circuits, such as current control circuits 14, 15, 16 of FIG. 3 (not shown in FIGS. 9A-E) may also be provided. As shown in FIG. 9E, traces 60, 62, 64 (which are only partly visible since some of these traces pass to the lower side of the submount 42) couple the contact pairs to the individual LEDs 48. As discussed above, in some embodiments, the LEDs 48 may be arranged in three strings, with the LEDs 48 in each string connected in series. In one embodiment, two strings can include up to ten LEDs each, and the other string may include up to eight LEDs, for a total of up to twenty-eight LEDs operable in three separate strings.

The current control circuits 14, 15, 16 (see FIG. 3; not shown in FIGS. 9A-E) may be used to independently control the drive current that is supplied to each of the three LED strings via traces 60, 62, 64. As discussed above, the drive currents may be separately adjusted to tune the combined light output of the packaged device 40 to more closely approximate a target color point, even when the individual LEDs 48 may deviate to some degree from output light color coordinates and/or lumen intensities that are specified in the design of device 40. Various control components known in the art may be used to effectuate separate control of the drive currents provided to the three strings of LEDs via traces 60, 62, 64, and hence additional discussion thereof will be omitted here.

To promote heat dissipation, the packaged device 40 may include a thermally conductive (e.g., metal) layer 92 on a bottom surface of the submount 42. The conductive layer 92 may cover different portions of the bottom surface of the submount 42; in one embodiment as shown, the metal layer 92 may cover substantially the entire bottom surface. The conductive layer 92 may be in at least partial vertical alignment with the LEDs 48. In one embodiment, the conductive layer is not in electrical communication with elements (e.g., LEDs) disposed on top surface of the submount 42. Heat that may concentrate below individual LEDs 48 will pass into the submount 42 disposed directly below and around each LED 48. The conductive layer 92 can aid heat dissipation by allowing this heat to spread from concentrated areas proximate the LEDs into the larger area of the layer 92 to promote dissipation and/or conductive transfer to an external heat sink (not shown). The conductive layer 92 may include holes 94 providing access to the submount 42, to relieve strain between the submount 42 and the metal layer 92 during fabrication and/or during operation. In certain embodiments, thermally conductive vias or plugs that pass at least partially through the submount 42 and are in thermal contact with the conductive layer 92 may be provided. The conductive vias or plugs promote passage of heat from the submount 42 to the conductive layer 92 to further enhance thermal management.

While FIGS. 9A-E illustrate one exemplary package configuration for light emitting devices according to embodiments of the present invention, it will be appreciated that any suitable packaging arrangement may be used. In some embodiments, each string of one or more LEDs may be provided in its own package, and the packages for each string are then mounted together on a submount. A diffuser may be provided that receives light emitted by each package and mixes that light to provide an output having the desired color point.

Figure 10:
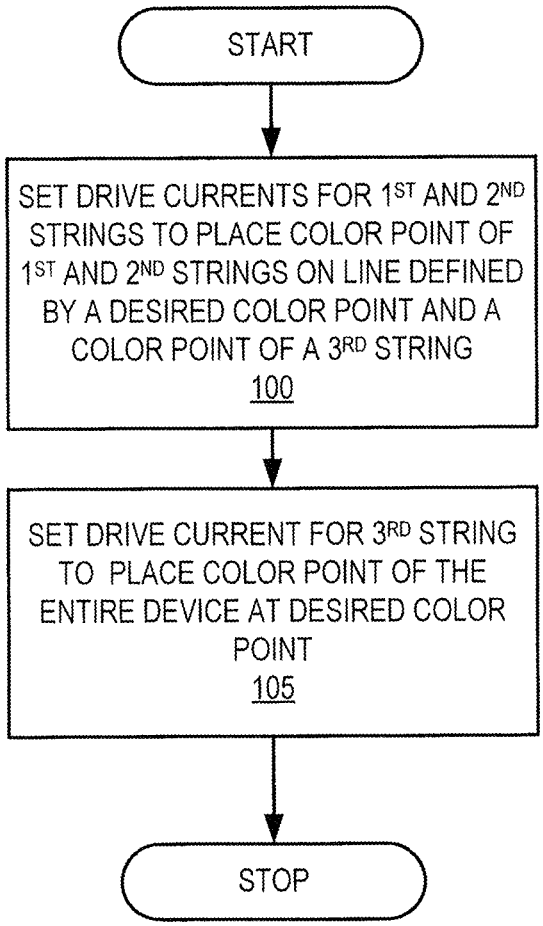
FIG. 10 is a flowchart illustrating operations for tuning a semiconductor light emitting device according to embodiments of the present invention.

Methods of tuning a multi-emitter semiconductor light emitting device to a desired color point according to embodiments of the present invention will now be further described with respect to the flow chart of FIG. 10.

As shown in FIG. 10, operations may begin with the relative drive currents provided to a first string of at least one light emitting diode ("LED") and to a second string of at least one LED being set so that the color point on the 1931 CIE Chromaticity Diagram of the combined output of the first string and the second string is approximately on a line that extends on the 1931 CIE Chromaticity Diagram through the desired color point and a color point of a combined output of a third string of at least one LED (block 100). Then, a drive current that is provided to the third string of at least one LED is set so that the color point on the 1931 CIE Chromaticity Diagram of the combined output of the packaged multi-emitter semiconductor light emitting device is approximately at the desired color point (block 105).

In some embodiments, the first string of LEDs may include at least one BSY LED, and the second string of LEDs may include at least one BSG LED. The third string of at least one LED may include at least one red LED and/or at least one BSR LED. The color point on the 1931 CIE Chromaticity Diagram of the combined output of the multi-emitter semiconductor light emitting device may be within three MacAdam ellipses from a selected color point on the black-body locus.

In some embodiments of the present invention, the drive currents supplied to the strings may be set in the fashion described above at the factory in order to tune the device to a particular color point. In some cases, adjustable resistors or resistor networks, digital to analog converters with flash memory, and/or fuse link diodes may then be set to fixed values so that the packaged semiconductor light emitting device will be set to emit light at or near the desired color point. However, according to further embodiments of the present invention, semiconductor light emitting devices may be provided which allow an end user to set the color point of the device.

For example, in some embodiments, semiconductor light emitting devices may be provided that include at least two different color temperature settings. By way of example, a device might have a first setting at which the drive currents to various strings of light emitting devices that are included in the device are set to provide a first light output having a color temperature of between 4000K and 5000K, which end users may prefer in the daytime, and a second light output having a color temperature of between 2500K and 3500K, which users may prefer at night.

Figure 11:
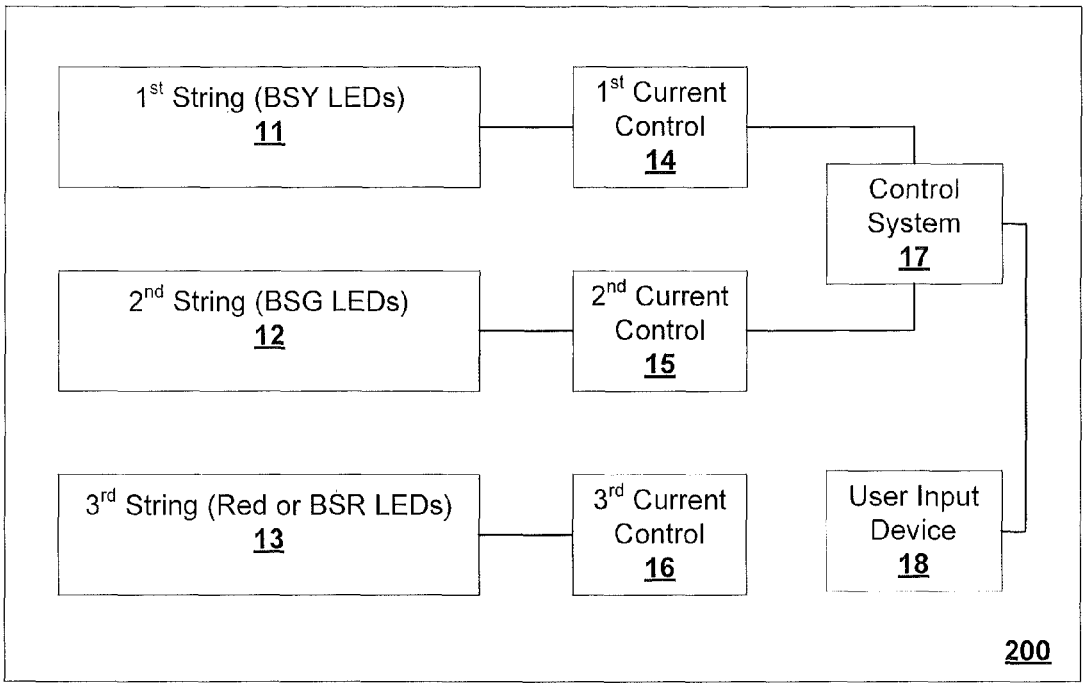
FIG. 11 is a schematic diagram of a semiconductor light emitting devices having user-selectable color points according to certain embodiments of the present invention.

FIG. 11 illustrates a packaged semiconductor light emitting device 200 according to certain embodiments of the present invention that is configured so that an end user to adjust the color point of the light output by the device 200. The particular device 200 depicted in FIG. 11 takes advantage of the fact that BSY LEDs and BSG LEDs may be selected such that a first color point that represents the output of a BSY LED string and a second color point that represents the output of a BSG LED string may define a line that runs generally parallel to the black-body locus 4, as is apparent from FIG. 2. As such, by adjusting the relative drive currents supplied to a BSY LED string and a BSG LED string, it may be possible for an end user to adjust the color point of the device 200 to move more or less along a selected portion of the black-body locus 4. Moreover, it has been discovered that at warmer color temperatures, the emissions from a string of BSY LEDs and red LEDs may generate light having both high CRI Ra values and good luminous efficiency. Likewise, at cooler color temperatures, the emissions from a string of BSG LEDs and red LEDs may generate light having both high CRI Ra values and good luminous efficiency.

Turning to FIG. 11, it can be seen that the device 200 includes a first string of BSY LEDs 11, a second string of BSG LEDs 12, and a third string of red-light emitting LEDs 13. The device 200 also includes first, second and third current control circuits 14, 15, 16, which were described above with respect to FIG. 3. The device 200 further includes a user input device 200 which could comprise, for example, a knob, slider bar or the like that are commonly used as dimming elements on conventional dimmer switches for incandescent lights. When an end user adjusts the position of this input device, a control signal is generated that is provided to a control system 17. In response to this control signal, the control system 17 sends control signals to one or both of the first and second current control circuits 14, 15 which cause one or both of those circuits to adjust their output drive currents in a fashion that changes the relative levels of the drive currents supplied to BSY LED string 11 and BSG LED string 12. By adjusting these relative drive current levels, the combined output of the strings 11 and 12 moves along a line defined by the color point of string 11 and the color point of string 12. As noted above, the device 200 may be designed so that this line runs generally parallel to the black-body locus 4. So long as the drive current supplied by the third control circuit 16 is factory set to place the color point of the combined output of the device 200 at or near the black body locus, the end user may use the user input device 18 to change the color temperature of the device 200 over a fairly broad range (e.g., 2800 K to 6500 K) while still keeping the color point of the device 200 on or near the black body locus 4.

A wide variety of changes may be made to the device 200 of FIG. 11. For example, in other embodiments, an end user could be provided input devices that allow control of the relative drive currents of (1) string 11 to string 12 and (2) the combination of strings 11 and 12 to string 13. In such embodiments, the end user can control the device 200 to emit light over a much wider range of color points. In a further embodiment, the end user could be provided independent control of the drive current to each of strings 11, 12 and 13. In still other embodiments, the user input device 18 could be a multi-position switch (e.g., 2 to 6 positions), where each position corresponds to drive current for each string 11, 12, 13 that provides light having a pre-set color point (e.g., pre-set color points 500K or 1000K apart along the black-body locus 4).

According to still further embodiments of the present invention, tunable multi-emitter semiconductor light emitting devices are provided which automatically adjust the drive currents provided to one or more of multiple strings of light emitting devices included therein. By way of example, it is known that when LEDs constructed using different semiconductor material systems (e.g., both GaN-based LEDs and InAlGaP-based LEDs) are used in the same light emitting device, the characteristics of the LEDs may vary differently with operating temperature, over time, etc. As such, the color point of the light produced by such devices is not necessarily stable. Pursuant to further embodiments of the present invention, tunable packaged multi-emitter semiconductor light emitting devices are provided with automatically adjusting drive currents that compensate for such variable changes. The automatic adjustment may, for example, be pre-programmed or responsive to sensors.

Figure 12:
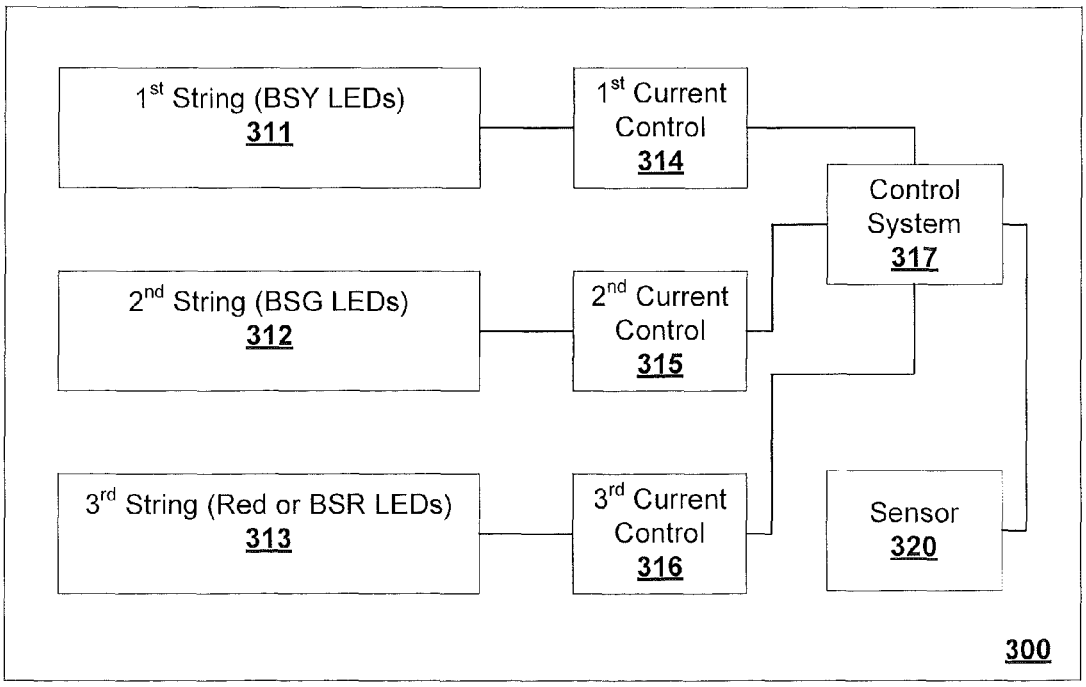
FIG. 12 is a schematic diagram of a semiconductor light emitting devices having automatically adjustable color points according to certain embodiments of the present invention.

FIG. 12 is a schematic block diagram of a tunable multi-emitter semiconductor light emitting device 300 that is configured to automatically adjust the drive currents provided to the LED strings included therein. As shown in FIG. 12, the device 300 includes one a first string of LEDs 311, a second string of LEDs 312, and a third string of LEDs 313. In some embodiments, the first string 311 may comprise one or more BSY LEDs, the second string 312 may comprise one or more BSG LEDs, and the third string 313 may comprise one or more red LEDs and/or one or more BSR LEDs.

The device 300 also includes first, second and third current control circuits 314, 315, 316. The first, second and third current control circuits 314, 315, 316 are configured to provide respective drive currents to the first, second and third strings of LEDs 311, 312, 313, and may be used to set the drive currents that are provided to the respective first through third strings of LEDs 311, 312, 313 at levels that are set so the device 300 will emit combined radiation at or near a desired color point.

The device 300 further includes a control system 317 and a sensor 320. The sensor 320 may sense various characteristics such as, for example, the temperature of the device 300. Data regarding the sensed characteristics is provided from the sensor 320 to the control system 317. In response to this data, the control system 317 may automatically cause one or more of the first, second and third current control circuits 314, 315, 316 to adjust the drive currents that are provided to the respective first, second and third strings of LEDs 311, 312, 313. The control system 317 may be programmed to adjust the drive currents that are provided to the respective first, second and third strings of LEDs 311, 312, 313 in a manner that tends to maintain the color point of the light emitted by the device 300 despite changes in various characteristics such as the temperature of the device 300.

In some embodiments, the control system 317 may also be pre-programmed to make adjustments to the drive currents that is not responsive to data from sensor 320. For example, if the emissions of, for example, the LEDs in the third string of LEDs 313 degrades over time more quickly than the emissions of the first and second strings of LEDs 311, 312, then the control system 317 may be pre-programmed to, for example, cause the third current control circuit 316 to slowly increase the drive current that is provided to the third string of LEDs 313 over time (e.g., in discrete steps at certain time points) in order to better maintain the color point of the light emitted by the device 300 over time.

Various embodiments of the present invention that are discussed above adjust the drive current supplied to one or more of multiple strings of light emitting devices that have separate color points in order to adjust a color point of the overall light output of the device. It will be appreciated that there are numerous ways to provide strings of light emitting devices that have different color points. For instance, in some of the embodiments discussed above, identical LEDs may be used in each of the multiple strings, while each of the strings use different recipient luminophoric mediums in order to provide multiple strings having different color points. In other embodiments, some strings may use the same underlying LEDs and different recipient luminophoric mediums, while other strings use different LEDs (e.g., a saturated red LED) in order to provide the multiple strings having different color points. In still further embodiments, some strings may use the recipient luminophoric mediums and different underlying LEDs (e.g. a first string uses 450 nm blue LEDs and a BSY recipient luminophoric medium and a second string uses 470 nm blue LEDs and the same BSY recipient luminophoric medium), while other strings use different LEDs and/or different recipient luminophoric mediums in order to provide the multiple strings having different color points.

Many different embodiments have been disclosed herein, in connection with the above description and the drawings. It will be understood that it would be unduly repetitious and obfuscating to literally describe and illustrate every combination and subcombination of these embodiments. Accordingly, the present specification, including the drawings, shall be construed to constitute a complete written description of all combinations and subcombinations of the embodiments described herein, and of the manner and process of making and using them, and shall support claims to any such combination or subcombination.

While embodiments of the present invention have primarily been discussed above with respect to semiconductor light emitting devices that include LEDs, it will be appreciated that according to further embodiments of the present invention, laser diodes and/or other semiconductor lighting devices may be provided that include the luminophoric mediums discussed above.

The present invention has been described above with reference to the accompanying drawings, in which certain embodiments of the invention are shown. However, this invention should not be construed as limited to the embodiments set forth herein. Rather, these embodiments are provided so that this disclosure will be thorough and complete, and will fully convey the scope of the invention to those skilled in the art. In the drawings, the thickness of layers and regions are exaggerated for clarity. Like numbers refer to like elements throughout. As used herein the term "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that, when used in this specification, the terms "comprises" and/or "including" and derivatives thereof, specify the presence of stated features, operations, elements, and/or components, but do not preclude the presence or addition of one or more other features, operations, elements, components, and/or groups thereof.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

It will be understood that, although the terms first, second, etc. may be used herein to describe various elements, components, regions and/or layers, these elements, components, regions and/or layers should not be limited by these terms. These terms are only used to distinguish one element, component, region or layer from another element, component, region or layer. Thus, a first element, component, region or layer discussed below could be termed a second element, component, region or layer without departing from the teachings of the present invention.

Furthermore, relative terms, such as "lower" or "bottom" and "upper" or "top," may be used herein to describe one element's relationship to another element as illustrated in the figures. It will be understood that relative terms are intended to encompass different orientations of the device in addition to the orientation depicted in the figures. For example, if the device in the figures is turned over, elements described as being on the "lower" side of other elements would then be oriented on "upper" sides of the other elements. The exemplary term "lower", can therefore, encompasses both an orientation of "lower" and "upper," depending on the particular orientation of the figure.

Embodiments of the invention are described herein with reference to cross-section illustrations that are schematic illustrations of idealized embodiments (and intermediate structures) of the invention. The thickness of layers and regions in the drawings may be exaggerated for clarity. Additionally, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

In the drawings and specification, there have been disclosed embodiments of the invention and, although specific terms are employed, they are used in a generic and descriptive sense only and not for purposes of limitation, the scope of the invention being set forth in the following claims.

What is claimed is:

1. A light emitting device, comprising:

a first string of at least one light emitting diode ("LED");

a second string of at least one LED;

a third string of at least one LED;

a drive circuit that is configured to set the relative drive currents provided to the first string and to the second string so that the color point on the 1931 CIE Chromaticity Diagram of the combined output of the first string and the second string is approximately on a line that extends on the 1931 CIE Chromaticity Diagram through a pre-selected color point and a color point of an output of the third string, and that is further configured to set the relative drive currents provided to the third string relative to the drive currents provided to the first and second strings so that the color point on the 1931 CIE Chromaticity Diagram of the combined output of the light emitting device is approximately at the pre-selected color point wherein one of the first through third strings includes at least one blue-shifted-yellow LED, and wherein one of the first through third strings of LEDs includes at least one blue-shifted-green LED.

2. The light emitting device of claim 1, wherein the first string of LEDs includes the at least one blue-shifted-yellow LED, and wherein the second string of LEDs includes the at least one blue-shifted-green LED.

3. The light emitting device of claim 2, wherein the third string includes at least one LED that emits radiation having a spectral power distribution that has a peak with a dominant wavelength between 600 and 660 nm.

4. The light emitting device of claim 3, wherein the color point on the 1931 CIE Chromaticity Diagram of the combined output of the light emitting device is within three MacAdam ellipses from the pre-selected color point.

5. A method of tuning a multi-emitter semiconductor light emitting device to a desired color point, the method comprising:

setting the relative drive currents provided to a first string of at least one light emitting diode ("LED") and to a second string of at least one LED so that the color point on the 1931 CIE Chromaticity Diagram of the combined output of the first string and the second string is approximately on a line that extends on the 1931 CIE Chromaticity Diagram through the desired color point and a color point of a combined output of a third string of at least one LED; and setting a drive current provided to the third string of at least one LED so that the color point on the 1931 CIE Chromaticity Diagram of the combined output of the multi-emitter semiconductor light emitting device is approximately at the desired color point wherein one of the first through third strings of LEDs includes at least one blue-shifted-yellow LED, and wherein one of the first through third strings of LEDs includes at least one blue-shifted-green LED.

6. The method of claim 5, wherein the first string of LEDs includes the at least one blue-shifted-yellow LED, and wherein the second string of LEDs includes the at least one blue-shifted-green LED.

7. The method of claim 6, wherein the color point on the 1931 CIE Chromaticity Diagram of the combined output of the multi-emitter semiconductor light emitting device is within three MacAdam ellipses from a selected color point on the black-body locus.

8. The method of claim 5, wherein the third string of at least one LED includes at least one LED that emits radiation having a spectral power distribution that has a peak with a dominant wavelength between 600 and 660 nm.

9. A semiconductor light emitting device, comprising:

a first light emitting diode ("LED") that emits radiation having a peak wavelength between 400 and 490 nm that includes a first recipient luminophoric medium, wherein a color point of the combined light output of the first LED and the first recipient luminophoric medium falls within the region on the 1931 CIE Chromaticity Diagram defined by x, y chromaticity coordinates (0.32, 0.40), (0.36, 0.48), (0.43 0.45), (0.36, 0.38), (0.32, 0.40);

a second LED that emits radiation having a peak wavelength between 400 and 490 nm that includes a second recipient luminophoric medium, wherein a color point of the combined light output of the second LED and the second recipient luminophoric medium falls within the region on the 1931 CIE Chromaticity Diagram defined by x, y chromaticity coordinates (0.35, 0.48), (0,26, 0.50), (0.13 0.26), (0.15, 0.20), (0.26, 0.28), (0.35, 0.48);

a third light source that emits radiation having a dominant wavelength between 600 and 720 nm;

a first circuit that is configured to provide an operating current to at least one of the first LED or the second LED; and an independently controllable second circuit that configured to provide an operating current to the third light source.

10. The semiconductor light emitting device of claim 9, wherein the first circuit is configured to provide an operating current to the first LED, and wherein the semiconductor light emitting device further includes a third circuit that is configured to provide an operating current to the second LED.

11. The semiconductor light emitting device of claim 10, wherein the first, second and third circuits are controllable such that they can provide different operating currents to the respective first LED, second LED and third light source.

12. The semiconductor light emitting device of claim 11, wherein the third light source comprises an InAlGaP based LED.

13. The semiconductor light emitting device of claim 11, wherein the third light source comprises a third LED that emits radiation having a peak wavelength between 400 and 490 nm that includes a third recipient luminophoric medium that emits radiation having a dominant wavelength between 600 and 660 nm.

14. The semiconductor light emitting device of claim 11, further comprising a fourth LED that emits radiation having a dominant wavelength between 490 and 515 nm.

15. The semiconductor light emitting device of claim 14, wherein one of the first circuit or the second circuit is further configured to provide an operating current to the fourth LED.

16. The semiconductor light emitting device of claim 11, wherein the first, second and third circuits are configured to deliver operating currents to the respective first LED, the second LED and the third light source that cause the semiconductor light emitting device to generate radiation that is within three MacAdam ellipses from a selected color point on the black-body locus.

17. The semiconductor light emitting device of claim 10, further comprising:

at least one additional first LED that emits radiation having a peak wavelength between 400 and 490 nm that includes another first recipient luminophoric medium, wherein a color point of the combined light output of the at least one additional first LED and the another first recipient luminophoric medium falls within the region on the 1931 CIE Chromaticity Diagram defined by x, y chromaticity coordinates (0.32, 0.40), (0.36, 0.48), (0.43 0.45), (0.36, 0.38), (0.32, 0.40);

at least one additional second LED that emits radiation having a peak wavelength between 400 and 490 nm that includes another second recipient luminophoric medium, wherein a color point of the combined light output of the at least one additional second LED and the another second recipient luminophoric medium falls within the region on the 1931 CIE Chromaticity Diagram defined by x, y chromaticity coordinates (0.35, 0.48), (0.26, 0.50), (0.13 0.26), (0.15, 0.20), (0.26, 0.28), (0.35, 0.48);

at least one additional third light source that emits radiation having a dominant wavelength between 600 and 660 nm;

wherein the first circuit is configured to provide an operating current to the first LED and the at least one additional first LED;

wherein the third circuit is configured to provide an operating current to the second LED and the at least one additional second LED; and wherein the second circuit is further configured to provide an operating current to the at least one additional third light source.

18. The semiconductor light emitting device of claim 10, wherein the semiconductor light emitting device emits a warm white light having a correlated color temperature between about 2500K and about 4100K and a CRI Ra value of at least 90.

19. A semiconductor light emitting device, comprising:

a first light emitting diode ("LED") string that includes at least one first type of LED;

a second LED string that includes at least one second type of LED;

a third LED string that includes at least one third type of LED;

a circuit that allows an end user of the semiconductor light emitting device to adjust the relative values of the drive current provided to the LEDs in the first and second LED strings to adjust a color point of the light emitted by the semiconductor light emitting device.

20. The semiconductor light emitting device of claim 19, wherein:

the at least one first type of LED comprises an LED that emits radiation having a peak wavelength between 400 and 490 nm that includes a first recipient luminophoric medium, wherein a color point of the combined light output of the at least one first type of LED and the first recipient luminophoric medium falls within the region on the 1931 CIE Chromaticity Diagram defined by the following x, y chromaticity coordinates: (0,32, 0.40), (0.36, 0.48), (0.43 0.45), (0.36, 0.38), (0.32, 0.40);

the at least one second type of LED comprises an LED that emits radiation having a peak wavelength between 400 and 490 nm that includes a second recipient luminophoric medium, wherein a color point of the combined light output of the at least one second type of LED and the second recipient luminophoric medium falls within the region on the 1931 CIE Chromaticity Diagram defined by the following x, y chromaticity coordinates: (0.35, 0.48), (0.26, 0.50), (0.13 0.26), (0.15, 0.20), (0.26, 0.28), (0.35, 0.48);

the at least one third type of LED comprises an LED that has one or more emission peaks that includes an emission peak having a dominant wavelength between 600 and 720 nm.

21. The semiconductor light emitting device of claim 20, wherein the circuit that allows an end user of the semiconductor light emitting device to adjust the relative values of the drive current provided to the LEDs in the first and second LED strings is configured to keep the overall luminous flux output by the semiconductor light emitting device relatively constant.

22. The semiconductor light emitting device of claim 19, wherein the circuit comprises a first circuit, and wherein the device further includes a second circuit that allows an end user of the semiconductor light emitting device to adjust the amount of drive current provided to the LEDs in the first and second LED strings relative to the drive current provided to the LEDs in the third LED string.

23. The semiconductor light emitting device of claim 22, wherein the circuit is configured to adjust the amount of drive current provided to the LEDs in the first through third strings of LEDs to one of a plurality of pre-defined levels that correspond to pre-selected color points.

* * * * *

UNITED STATES PATENT AND TRADEMARK OFFICE

CERTIFICATE OF CORRECTION

PATENT NO. : 8,796,952 B2
APPLICATION NO. : 13/039572
DATED : August 5, 2014
INVENTOR(S) : Van de Ven It is certified that error appears in the above-identified patent and that said Letters Patent is hereby corrected as shown below:

In the Claims:

Column 26, Claim 9, Lines 43 and 44: Correct "(0,26, 0.50),"
to read -- (0.26, 0.50), --

Signed and Sealed this
Ninth Day of December, 2014

Michelle K. Lee

Michelle K. Lee
*Deputy Director of the United States Patent and Trademark Office*